US007699436B2

(12) United States Patent
Shibata et al.

(10) Patent No.: US 7,699,436 B2
(45) Date of Patent: Apr. 20, 2010

(54) INK JET PRINTING METHOD AND INK JET PRINTING APPARATUS

(75) Inventors: Tsuyoshi Shibata, Yokohama (JP); Eri Noguchi, Yokohama (JP); Hiromitsu Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 531 days.

(21) Appl. No.: 11/755,431

(22) Filed: May 30, 2007

(65) Prior Publication Data

US 2007/0216724 A1 Sep. 20, 2007

Related U.S. Application Data

(63) Continuation of application No. PCT/JP2005/022899, filed on Dec. 13, 2005.

(30) Foreign Application Priority Data

Dec. 13, 2004 (JP) ..... 2004-360514

(51) Int. Cl.
*B41J 2/15* (2006.01)
*B41J 2/145* (2006.01)

(52) U.S. Cl. ..... 347/41; 347/12; 347/9

(58) Field of Classification Search ..... 347/9, 347/12, 16, 20, 40–44
See application file for complete search history.

(56) References Cited

U.S. PATENT DOCUMENTS 6,003,970 A * 12/1999 Fujita et al. ..... 347/41
6,334,659 B1 1/2002 Maeda et al.
6,874,864 B1 4/2005 Maeda et al.
2007/0236745 A1 10/2007 Noguchi et al.
2007/0285450 A1 12/2007 Noguchi

FOREIGN PATENT DOCUMENTS

JP 2000-108321 A 4/2000
JP 2001-18376 A 1/2001
JP 2002-96455 A 4/2002
JP 2002-125122 A 4/2002

* cited by examiner

*Primary Examiner*—Juanita D Stephens
(74) *Attorney, Agent, or Firm*—Fitzpatrick, Cella, Harper & Scinto

(57) ABSTRACT

The present invention allows a high-speed printing by a print head in which nozzles are arranged with a high density to reduce eddy flow caused between the print head and a print medium, providing an image with a high quality. Thus, the present invention allows the same printing region of the print medium to be sequentially printed by the respective nozzle arrays provided in the print head in accordance with image data thinned-out by the mask pattern M, thereby completing the image by multi-pass. Then, a plurality of pieces of image printed to be printed to the same printing region at which the nozzle arrays pass in one pass are alternately thinned-out by different high and low thinning-out ratios in the direction in which the nozzles are arranged.

9 Claims, 31 Drawing Sheets

INK JET PRINTING METHOD AND INK JET PRINTING APPARATUS

This application is a continuation application of PCT application No. PCT/JP2005/022899 under 37 Code of Federal Regulations §1.53 (b) and the said PCT application claims the benefit of Japanese Patent Application No. 2004-360514, filed Dec. 13, 2004, which is hereby incorporated by reference herein in its entirety.

BACKGROUND OF THE INVENTION

1. Field of the Invention

The present invention relates to an ink jet printing method and an ink jet printing apparatus printing apparatus which print an image on a print medium by using an ink jet print head having a nozzle array in which nozzles for ejecting ink are arranged with a high density.

2. Description of the Related Art

With the diffusion of information processing devices and communication devices (e.g., computer, word processor), output devices for outputting digital image according to digital image information processed by the information processing devices have been increasingly required. One of these output devices is an ink jet printing apparatus printing apparatus that ejects ink droplets to form dots on a print medium to form an image. This ink jet printing apparatus printing apparatus has been widely used. This ink jet printing apparatus printing apparatus uses a print head that is designed, in order to improve the printing speed and the resolution of a printed image, to include a great number of integrated and arranged ejecting sections (hereinafter also referred as nozzles). The ejecting section consists of an ink ejecting port for ejecting ink droplets, a fluid path, and a printing element or the like.

Furthermore, there has been recently another demand for the output of a color printed image. Thus, an ink jet printing apparatus printing apparatus for printing a color image performs a printing operation using not only a print head for ejecting black ink but also print heads for ejecting a plurality of color inks. In the printing operation, the print heads have no contact with a print medium, thus providing a printing operation with low noise. The ink jet printing apparatus printing apparatus also can print an image having a high resolution with a high speed by arranging the nozzles with a higher density. Furthermore, this type of ink jet printing apparatus printing apparatus does not require a special processing (e.g., development, fixing) to a to-be-printed material (e.g., plain paper). Thus, this type of ink jet printing apparatus printing apparatus has various advantages such as the one providing a high quality image with a low cost. An on-demand-type ink jet printing apparatus printing apparatus in particular can provide a color image easily and can be downsized and simplified and thus is expected to create a growing demand in the future. With the increasing demand for a color-printed image, ink jet printing apparatus printing apparatuses are required to provide an image having a higher quality with a higher speed.

On the other hand, with the background of the recent technical progress for the integrated arrangement of nozzles, a print head having a further higher density and a longer length is becoming possible. Generally, a print head having a high density and a long length is called a long print head. This long print head can increase the width of a region that can be printed on a print medium by one printing scan to the print medium when compared to a case where a conventional short print head is used. Thus, this technique has been further developed as a useful technique for realizing a high-speed printing that has been conventionally impossible while maintaining a high image quality equal to that of a conventional design.

However, in the case of the ink jet printing apparatus printing apparatus as described above that uses a long print head having a high density, a problem as described below may be caused.

Specifically, when a long print head in which nozzles are arranged with a high density simultaneously ejects a great number of ink droplets while performing a printing scan by the print head or a scan of a print medium with a high speed, the print head and the print medium have therebetween irregular air current (eddy flow). This causes a problem that positions to which ink droplets land on the print medium are fluctuated. Furthermore, it has been known that the eddy flow between the print head and the print medium has a significant influence on how the ink droplets are ejected, which is also one of the causes of the deterioration of an ink landing accuracy. Another problem is that the fluctuation of the ink landing positions as described above causes the image to have a stripe-like or spiral-like uneven density, remarkably deteriorating the image quality. This has been hindrance to the realization of the printing of a high-quality image with a high speed.

As a technique for solving the stripe-like uneven density as described above, techniques disclosed in Japanese Patent Laid-Open No. 2001-18376 or Japanese Patent Laid-Open No. 2002-96455 are known.

Japanese Patent Laid-Open No. 2001-18376 discloses a technique in which nozzle arrays provided in a print head are divided to the printing ones and no-printing ones with a fixed pitch and the fixed pitch is further minutely divided. This technique can cause the stripe uneven density (stripe-uneven printing) to be the one that is difficult to be visually recognized.

Japanese Patent Laid-Open No. 2002-96455 also discloses a mask pattern for allocating, when a printing method is used by which a plurality of main scans complete an image within the same printing region, the operation for providing the image within the same printing region to a plurality of main scans. This mask pattern is set so that the end part side of the nozzle arrays have a higher thinning-out ratio than that of the center side. The use of this mask pattern can reduce the frequency at which the end part nozzle is used, thereby eliminating the uneven density caused by twisted eject from the end part nozzle.

However, the techniques according to the above Patent References still have room for improvement in that deterioration of an image due to eddy flow caused between a print head and a print medium is not sufficiently avoided. Specifically, the eddy flow caused between a print head and a print medium may be caused not only at the end part of the nozzle array but also at the entire region of the nozzle array. Influence by eddy flow between nozzle arrays also cannot be ignored. Thus, it is difficult for only the conventional techniques to avoid the deterioration of an image due to the generation of the eddy flow.

What is required for ink jet printing apparatus printing apparatuses in the future is to realize a printing of an image with both of a further higher speed and a further high quality. To do so, the deterioration of the quality of an image due to the eddy flow as described above needs to be improved.

SUMMARY OF THE INVENTION

It is an objective of the present invention to provide an ink jet printing apparatus printing apparatus and an ink jet printing method by which, even when a print head in which ink ejecting sections are arranged with a high density is used to perform a printing with a high speed, eddy flow caused between the print head and a print medium can be reduced to mitigate the decrease of the landing accuracy of ink droplets.

The present invention for achieving the above objective has the structure as shown below.

Specifically, the first aspect of the present invention is an ink jet printing apparatus for causing a plurality of nozzles arranged in a print head to eject ink droplets while the print head scans relative to a print medium, to print an image on the print medium, the apparatus comprising: scanning means for causing the print head to scan a same printing region of the print medium a plurality of times; thinning-out means for dividing image data corresponding to the same print region to pieces of image data to be printed by the respective plurality of scans by thinning-out image data corresponding to the same print region; and printing control means for printing, in accordance with the image data thinned out by the thinning-out means in the respective plurality of scans, a thinned-out image on the same print region to complete an image to be printed on the same print region, wherein the thinning-out means thins out image data to be printed on a plurality of same print regions at which the print head passes in one scanning with high and low thinning-out ratios in turn in a direction in which the nozzles are arranged.

The second aspect of the present invention is an ink jet printing apparatus for causing a plurality of nozzles arranged in a print head to eject ink droplets while the print head scans relative to a print medium, to print an image on the print medium, the apparatus comprising: scanning means for scanning the print head to a same print region of the print medium a plurality of times; conversion means for converting multivalued image data that corresponds to the respective pixels constituting an image to be printed on the same print region to binary image data; thinning-out means for thinning-out the binary image data corresponding to the same print region by using different mask patterns corresponding to respective plurality of scans to the same print region; and printing control means for printing, based on the binary image data thinned out by the thinning-out means in the respective plurality of scans, a thinned-out image on the same print region to complete the image to be printed on the same print region; wherein the respective different mask patterns are defined so that a first region for thinning-out the binary image data with a relatively high thinning-out ratio and a second region for thinning-out the binary image data with a relatively low thinning-out ratio are repeatedly arranged in a direction, in which the nozzles are arranged, in the unit of an integral multiple of the width of the pixel.

The third aspect of the present invention is an ink jet printing method for causing a plurality of nozzles arranged in a print head to eject ink droplets while the print head scans relative to a print medium, to print an image on the print medium, the method comprising: a scanning step for scanning the print head to a same printing region of the print medium a plurality of times; a thinning-out step for dividing image data corresponding to the same print region to image data to be printed in the respective plurality of scans by thinning-out image data corresponding to the same print region; and a printing step for printing thinned-out image on the same print region in accordance with image data thinned out by the thinning-out step in the respective plurality of main scans to complete an image to be printed on the same print region, wherein, in the thinning-out step, image data to be printed on a plurality of the same print regions at which a nozzle array of the print head passes during one scan is thinned out at high and low thinning-out ratios alternately in a direction in which the nozzles are arranged.

The fourth aspect of the present invention is an ink jet printing method for causing a plurality of nozzles arranged in a print head to eject ink droplets while the print head scans relative to a print medium to form an image on the print medium, the method comprising: a step for causing the print head to scan to a same print region of the print medium a plurality of times; a step for converting multivalued image data that corresponds to the respective pixels constituting an image to be printed on the same print region to binary image data; a step for thinning-out binary image data corresponding to the same print region using different mask patterns respectively corresponding to a plurality of scans to the same print region; and a step for printing, in the respective plurality of scans, thinned-out images on the same print region based on the thinned-out binary image data to complete an image to be printed on the same print region, wherein the respective different mask patterns include an arrangement of an region in which a printing of the binary image data is permitted and an region in which a printing of the binary image data is not permitted and are defined so that a part relatively highly occupied by the printing-permitted region and a part relatively lowly occupied by the printing-permitted region are repeatedly arranged along a direction, in which the nozzles are arranged, in the unit of an integral multiple of the width of the pixel.

In the present invention, the term "scan" denotes an operation as described below. Specifically, the term "scan" denotes an operation in which ink is ejected while causing a relative movement between one nozzle array in which nozzles are arranged in a substantially row arrangement and with a high density and a print medium in a direction crossing the direction in which the nozzles are arranged (which may be inclined), thereby printing a part or the entirety of the image. Thus, when a plurality of nozzle arrays are arranged in parallel in the main scan direction, a plurality of "scans" corresponding to the number of the arranged nozzle arrays will be described even when one relative movement between the respective nozzle arrays and the print medium is performed. The plurality of "scans" corresponding to the number of the repetition of the relative movements also will be described even when repeated relative movements between the respective nozzle arrays and the print medium are performed as in the case of the so-called multipass printing. For example, when three passes of multi-pass printing is performed by a head unit having three print heads for the same color, the total of nine "scans" will be described.

According to the present invention, even when a print head in which ink eject sections are arranged with a high density is used to perform a printing with a high speed, eddy flow caused between the print head and a print medium can be reduced to maintain, with a high accuracy, positions to which ink droplets land, thus providing an image with a high quality.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

Figure 1:
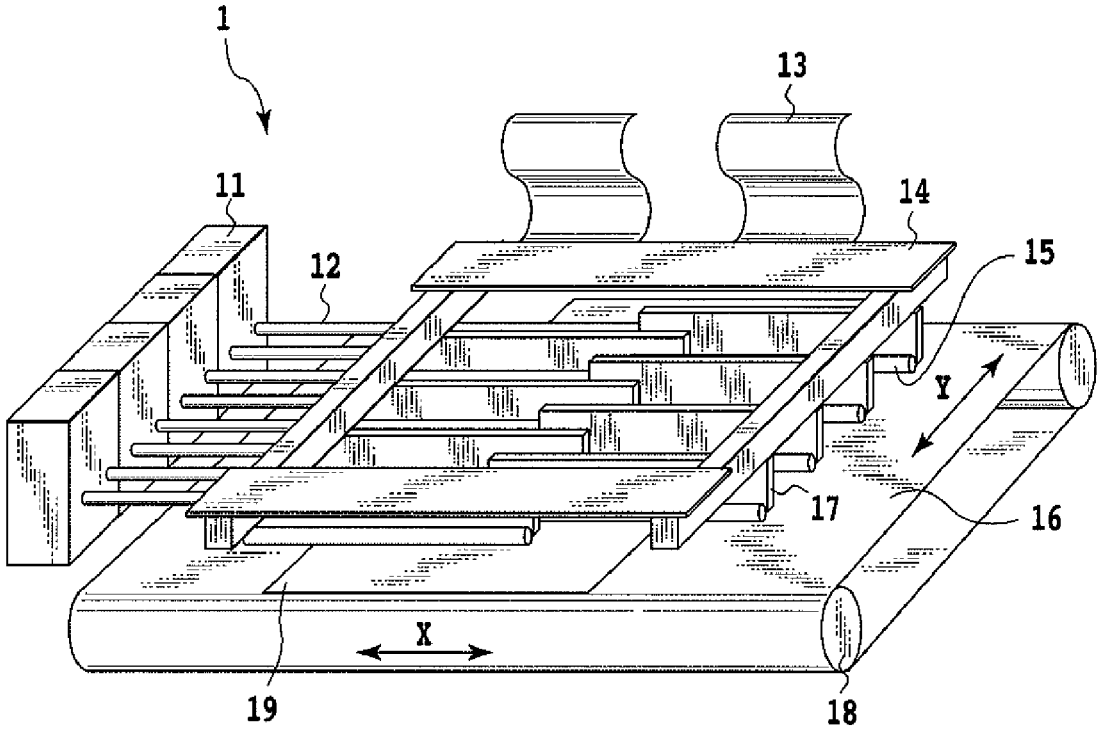
FIG. 1 is a perspective view of a full-line-type ink jet printing apparatus printing apparatus applied to an embodiment of the present invention.

FIG. 1 is a schematic perspective view of a full-line-type ink jet printing apparatus printing apparatus applicable to an embodiment of the present invention.

In FIG. 1, the reference numeral 11 denotes an ink tank for storing ink. This ink tank stores therein ink including a predetermined color material. The ink stored in this ink tank 11 is supplied via the ink supply section 12 to the line head (print head) 17. The line head 17 is retained so as to be moved up and down by the head retention member 14 and the interval between the line head 17 and the print medium 19 (hereinafter referred to as distance to paper) can be adjusted. It is noted that this line head is structured as described later in detail with reference to FIG. 2 so that a plurality of eject sections (hereinafter also may be referred to as nozzles) for ejecting ink are arranged with a high density in a direction orthogonal to the width direction of the print medium P (direction X). The reference 15 denotes a capping member provided so as to seal and open the eject ports of the respective nozzles provided in the line head 17. This capping member 15 is provided for each line head for the purpose of preventing the clogging of the respective nozzles due to a factor such as the ink fixation due to the evaporation of ink solvent or attachment of foreign material (e.g., dust). This capping member 15 is structured so as to be able to seal (cap) the ink eject port as required. The print medium P is supplied by a paper feed mechanism (not shown) to a transportation mechanism mainly including the transportation roller 18 and the transportation belt 16. The operations of this transportation mechanism and the line head 17 are controlled by a controller section (not shown). Specifically, the line head 17 ejects ink from the respective nozzles based on the eject data sent from the controller section to the color flexible cable 13. The transportation system transports the print medium in synchronization with the ink ejection operation in the line head 17. These transportation operation of print medium and ink ejection operation allow an image to be printed on the print medium.

Figure 3:
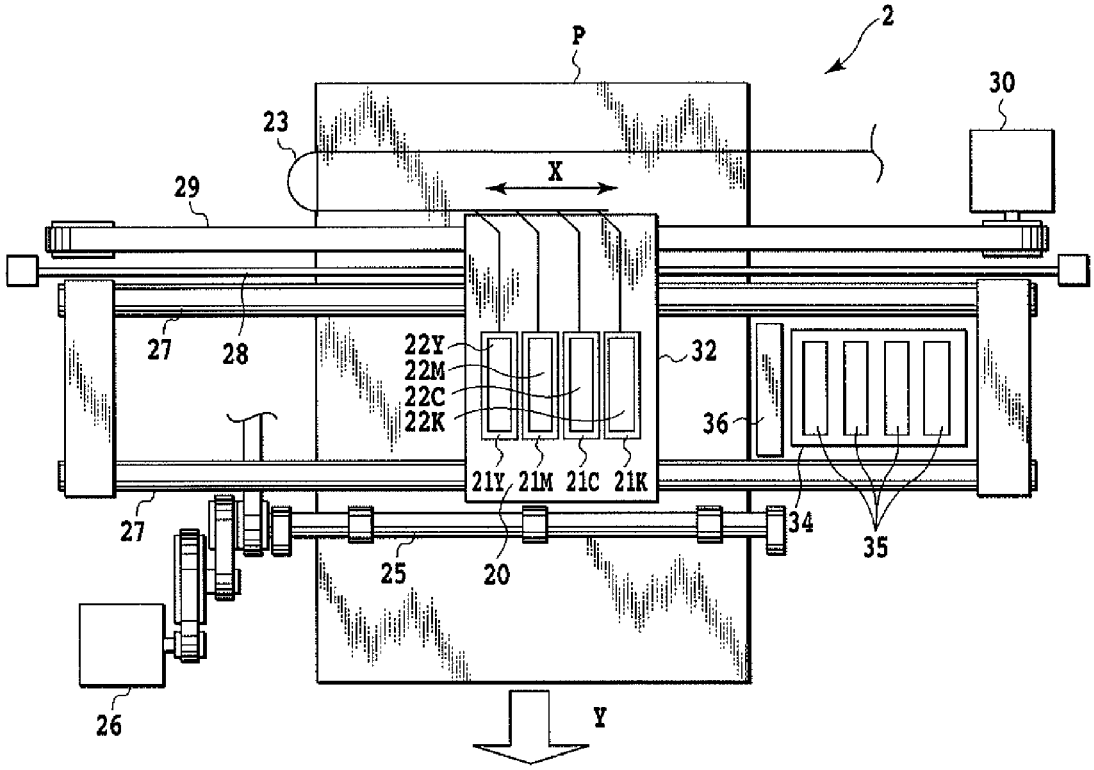
FIG. 3 is a plan view illustrating the schematic structure of a serial-type ink jet printing apparatus printing apparatus applied to an embodiment of the present invention.

FIG. 3 is a front view illustrating the schematic structure of a serial-type ink jet printing apparatus printing apparatus applicable to an embodiment of the present invention.

In FIG. 3, the reference numeral 32 denotes a carriage that is supported by the guide shaft 27 and the linear encoder 28 so as to able to have a reciprocating movement along a main scan direction (direction X). This carriage 32 has a reciprocating movement along the guide shaft 27 by driving the carriage motor 30 to move the driving belt 29. The carriage 32 also includes a plurality of ink jet print heads (hereinafter simply referred to as print head) 22 in a detachable manner. In each print head, a plurality of eject sections for ejecting ink (hereinafter also referred to as nozzles) are arranged in the main scan direction. Each nozzle of this print head 2 includes therein a fluid path that includes a heat generation element (electric thermal conversion material) for generating heat energy for ejecting ink in the fluid path. The reference numeral 21 denotes an ink tank for supplying ink of a predetermined color to the respective print head. These ink tank 21 and print head 22 constitute an ink cartridge.

This serial-type ink jet printing apparatus printing apparatus includes a transportation mechanism for transporting the print medium P such as a plain paper, a high-grade exclusive paper, an OHP sheet, a gloss paper, a gloss film, or a postcard. This transportation mechanism has a transportation roller (not shown), the paper ejection roller 25, and the transportation motor 26 or the like and is intermittently transported in the sub scan direction (direction Y) in accordance with the driving of the transportation motor 26.

The above print head 22 and transportation mechanism receive a eject signal and a control signal sent from a control section (which will be described later) via the flexible cable 23. In accordance with the eject signal and control signal, the respective print heads 22 and the transportation mechanism are operated.

Specifically, heat generation elements of a print head are driven based on the position signal of the carriage 32 outputted from the linear encoder 28 and a eject signal. Then, heat energy during the driving causes ink droplets to be ejected from the nozzles and the ink droplets land onto a print medium. Based on the control signal, the transportation mechanism moves the print medium for a fixed distance in the sub scan direction and within a period from one main scan of the print head to next main scan of the print head. By repeating this printing operation by the print head and the transportation operation by the transportation mechanism, an image is formed all over the print medium. The home position of the carriage 32 set to a position outside the printing region includes the recovery unit 34 including the cap section 35 that can seal and open a eject port provided at the print head.

Next, the structure of the eject section (nozzle) provided in the print head of the respective ink jet printing apparatus printing apparatus as described above will be described with reference to FIG. 6.

Figure 6:
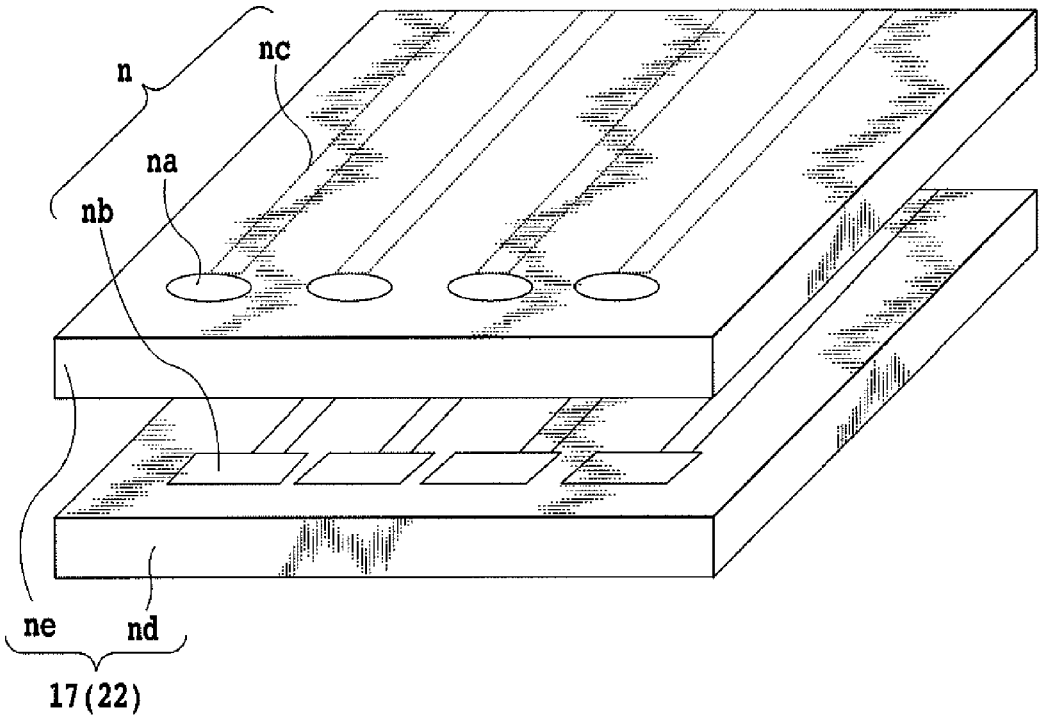
FIG. 6 is a schematic perspective view illustrating the inner structure of the print head used in the ink jet printing apparatus printing apparatus.

In FIG. 6, the print heads 17 and 22 are schematically composed by the heater board nd as a substrate including a plurality of heaters nb for heating ink and the top panel ne for covering this heater board nd. The top panel ne includes a plurality of eject ports na the rear of which has the tunnel-like fluid path nc communicating with this eject port na. The rear parts of the respective fluid paths nc are commonly connected to one ink room. The ink room is supplied with ink via an ink supply port. This ink is supplied from the ink room to the respective fluid paths nc.

This heater board nd and the top panel ne are positioned and joined so that each fluid path nc corresponds to each heater nb. Although FIG. 6 shows only four heaters nb, every one heater nb is provided to correspond to each fluid path nc. When this heater nb is supplied with a predetermined driving pulse, ink on the heater nb boils to form bubble. Cubical expansion of the bubbles cause the ink in the fluid path nc to be ejected from the eject port na as an ink droplet. The eject port na, the heater nb, and the fluid path nc constitute the nozzle (eject section) n.

An ink jet printing method applicable to the present invention is not limited to the one using the method as shown in FIG. 6 using a heat generation element (heater). For example, any charging-control-type or divergence-controlling-type continuance type ink jet method for continually injecting ink droplets to provide ink particles may be used. Alternatively, as an on-demand-type ink jet printing method for ejecting ink droplets as required, any pressure-controlling-type method or the like for ejecting ink droplets from the eject port by the mechanical vibration of piezo vibration elements also may be used.

Figure 7:
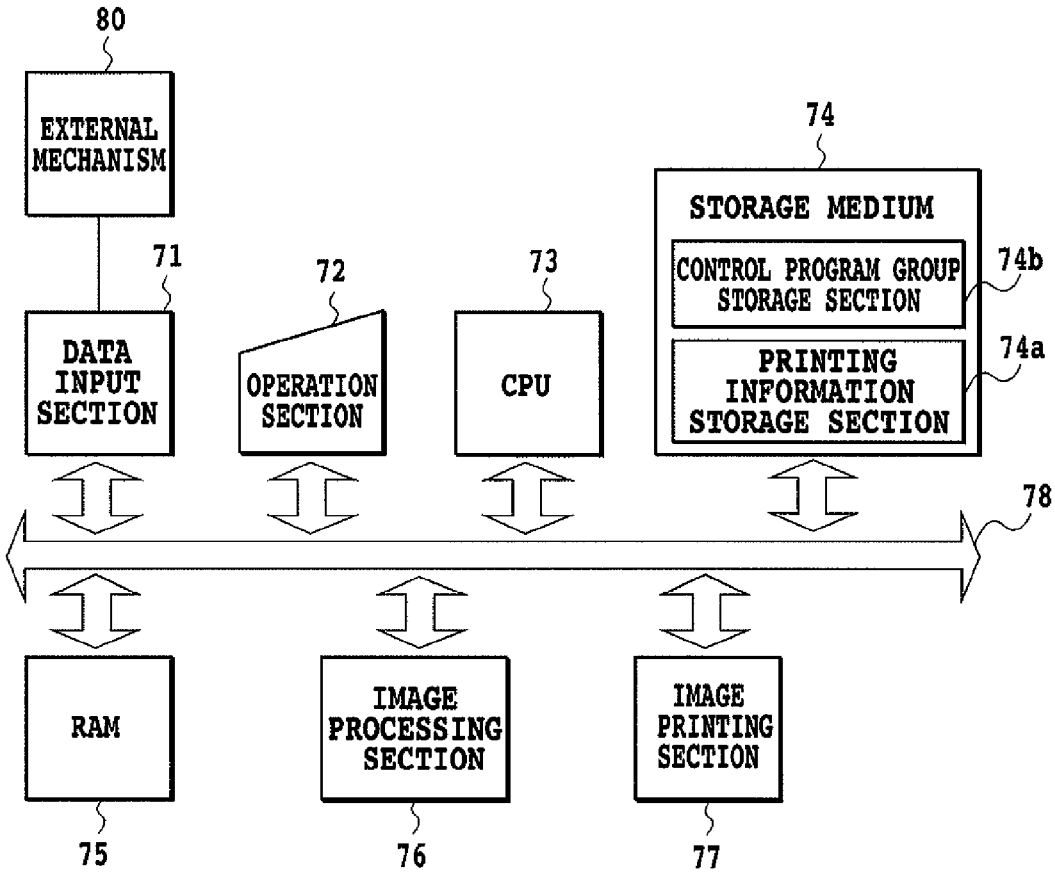
FIG. 7 is a schematic block diagram illustrating the control system of the ink jet printing apparatus printing apparatus of the embodiment of the present invention.

FIG. 7 is a schematic block diagram illustrating the control system of the ink jet printing apparatus printing apparatus in this embodiment.

In FIG. 7, the reference numeral 71 denotes a data input section for receiving image data and control data sent from the external device 80 (e.g., host computer). The reference numeral 72 denotes an operation section for performing a data input operation or a setting operation. The reference numeral 73 denotes CPU for performing various information processings and control operations. The reference numeral 74 denotes a storage medium for storing various pieces of data. This storage medium 74 includes the printing information storage section 74*a* for storing image printing information (e.g., information mainly regarding the type of the print medium, information regarding ink, information regarding environment (e.g., temperature and humidity during the printing)) and the program storage section 74*b* for storing various control program groups, for example. Furthermore, the reference numeral 75 denotes RAM for temporarily storing the processed data and input data of the CPU 72 for example. The reference numeral 76 denotes an image data processing section for performing a predetermined image processing (e.g., color conversion, binarization) to inputted image data. The reference numeral 77 denotes an image printing section for executing an image output by a print head or a transportation mechanism. The reference numeral 78 denotes a bus line for transmitting address signal, data, control signal or the like in this apparatus.

The structure will be described in more detail. The external device 80 may be, for example, an image input device (e.g., scanner, digital camera) or a personal computer. Multivalued image data outputted from the scanner, digital camera or the like (e.g., RGB 8 bit data) or multivalued image data stored in a hard disk of a personal computer or the like is inputted to the image data input section 71. The operation section 72 includes various keys for setting various parameters or for inputting an instruction for starting the printing for example. In accordance with various programs in the storage medium, the CPU 73 controls the entirety of the ink jet printing apparatus printing apparatus. Programs stored in the storage medium 74 include a program by which the ink jet printing apparatus printing apparatus is operated in accordance with a control program or an error processing program. The operation of this embodiment is all performed in accordance with this program. The storage medium 74 for storing this program may be ROM, FD, CD-ROM, HD, a memory card, a magnetic optical disk or the like. The RAM 75 is used as a work area in which various programs stored in the storage medium 74 are executed, a temporary save area for an error processing, and a work area for an image processing. The RAM 75 also can copy various tables in the storage medium 74 to subsequently change the contents of the table to proceed the image processing while referring to the changed table.

The image processing section 76 performs a color separation processing for converting inputted multivalued image data for each pixel (e.g., 8 bit RGB data) to multivalued data for each color (e.g., 8 bit CMYBk data). Then, the multivalued data for each pixel of each color is quantized to K-value data (e.g., 17 value). Then, a dot arrangement pattern corresponding to the gradation value "K" shown by the respective quantized pixel (gradation values of 0 to 16) is determined. Although this K-value processing uses the multivalued error diffusion method, the processing is not limited to this. Any other half-toning processing methods also may be used, including the average density storage method and Dither Matrix method. After the above-described K-value processing, a processing for providing a dot arrangement pattern is performed in which the respective tones correspond to dot arrangement patterns which will be described later (this pattern also may be referred to as the dot concentrated shape unit INDEX). Then, in a plurality of printing scans by the print head, to-be-printed binary data generated by the dot arrangement pattern processing is subjected to a thinning-out processing in which to-be-printed data is allocated to each printing scan. The plurality of printing scans by the print head also include one printing scan performed by a print head including two or more nozzle arrays.

By repeating these processings, to-be-printed binary data representing eject and no-eject to the respective nozzles of the print head is prepared. Then, the image printing section 77 ejects ink based on the to-be-printed binary data prepared by the image data processing section 76, thereby forming a dot image on a print medium.

Next, how nozzles are arranged in the print head used for the respective ink jet printing apparatus printing apparatuses will be described with reference to FIG. 2, FIG. 4, and FIG. 5.

Figure 2:
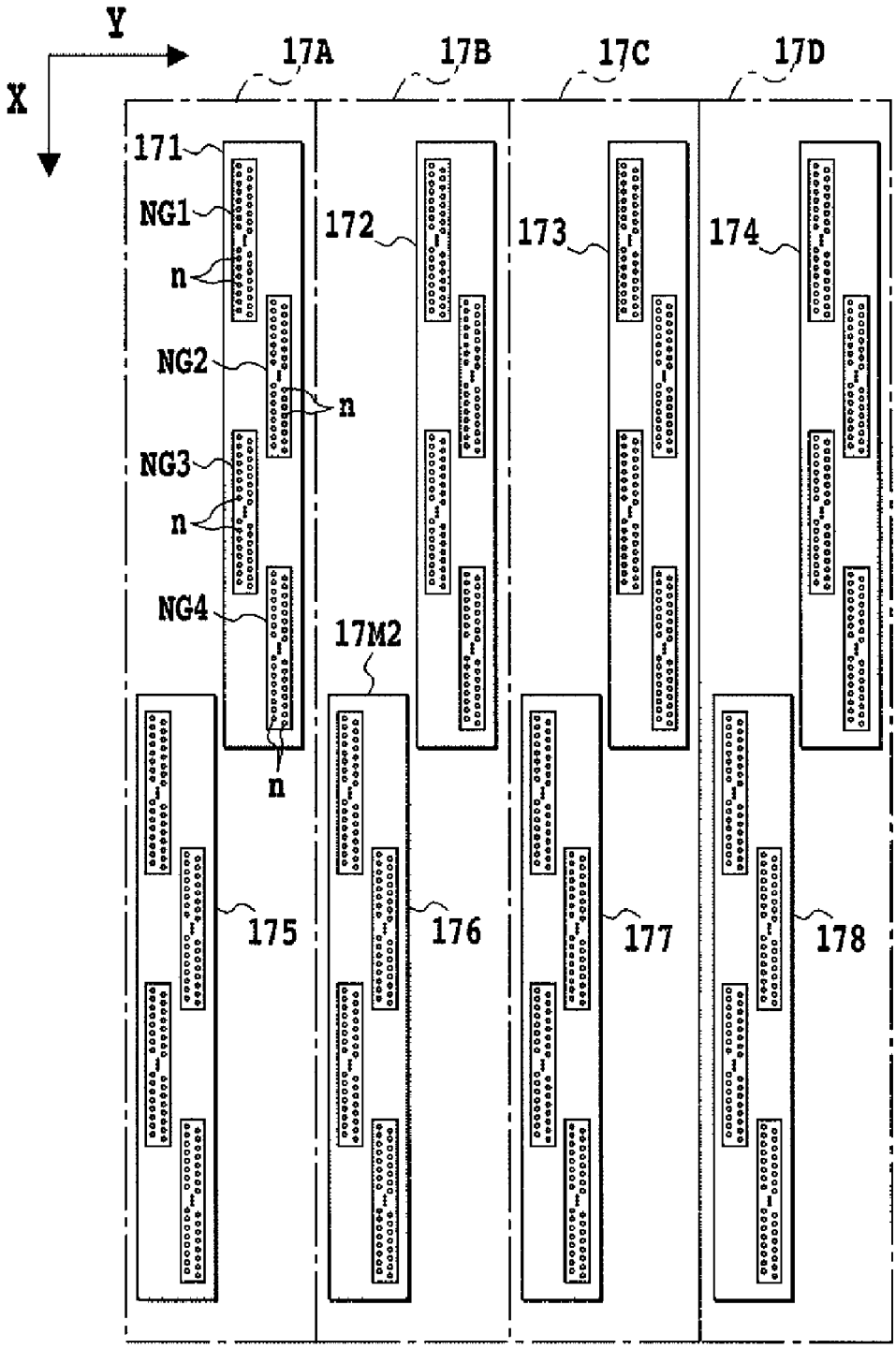
FIG. 2 illustrates an example of a line head used in the ink jet printing apparatus printing apparatus shown in FIG. 1.

FIG. 2 illustrates how nozzles of the print head (line head) 17 used for the full-line-type ink jet printing apparatus printing apparatus shown in FIG. 1 are arranged.

In FIG. 2, this print head 17 is provided such that a plurality of (four in this example) nozzle arrays 17A, 17B, 17C, and 17D are arranged in the direction in which a print medium is transported (direction Y). Each nozzle array has the same structure of a so-called connection head in which two intermediate nozzle arrays are connected. Specifically, the nozzle array 17A consists of the intermediate nozzle array 171 and the intermediate nozzle array 175. The line ink head 17B consists of the intermediate nozzle array 172 and the intermediate nozzle array 176. The line head 17C consists of the intermediate nozzle array 173 and the intermediate nozzle array 177. Furthermore, the line head 17D consists of the intermediate nozzle array 174 and the intermediate nozzle array 177.

The respective nozzle arrays 17A, 17B, 17C, and 17D constituting the respective line heads have the structure as shown below. Since the respective nozzle arrays have the same structure, the following description will describe the nozzle array 17A as an example.

The intermediate nozzle array 171 constituting the nozzle array 17A is composed by a plurality of (four in this example) small nozzle arrays NG1 to NG4. These small nozzle arrays are arranged in a staggered manner. Furthermore, each small nozzle array is provided so that a plurality of nozzles n for ejecting ink droplets of an average of 2.5 pl are arranged in a staggered manner, thereby allowing the nozzles to be arranged in the sub scan direction with a high density. Adjacent small nozzle arrays in the nozzle array 171 are provided so that the ends thereof are overlapped to one another, thereby providing the nozzle array with a fixed arrangement density. In this embodiment, nozzles in the nozzle array 171 are arranged with an arrangement density of 1200 dpi.

By the nozzle array provided as described above, the four small nozzle arrays (i.e., one intermediate nozzle array) can be used to print a region having a width of substantially 4 inch by one printing scan. Furthermore, by the entire line head, the respective nozzle arrays 171 and 175 can be used to print a region having a width of substantially 8 inch. Other line heads 17C, 17B, and 17D also have the same structure.

Although FIG. 2 showed the line head in which the four nozzle arrays are arranged in the sub scan direction (direction Y), the present invention is not limited to the line head having the structure as described above and also may be applied to a line head having other structures. For example, a structure in which a single nozzle ejects large and small ink droplets also may be used or a structure in which a single nozzle ejects deep color ink and light color ink also may be used. The present invention is also not limited to the four arrays and also can be applied to a structure in which nozzle arrays in an amount other than four are arranged.

Next, with reference to FIG. 4 and FIG. 5, an example of the structure of the print head used for the serial-type ink jet printing apparatus printing apparatus shown in FIG. 3 will be described.

Figure 4:
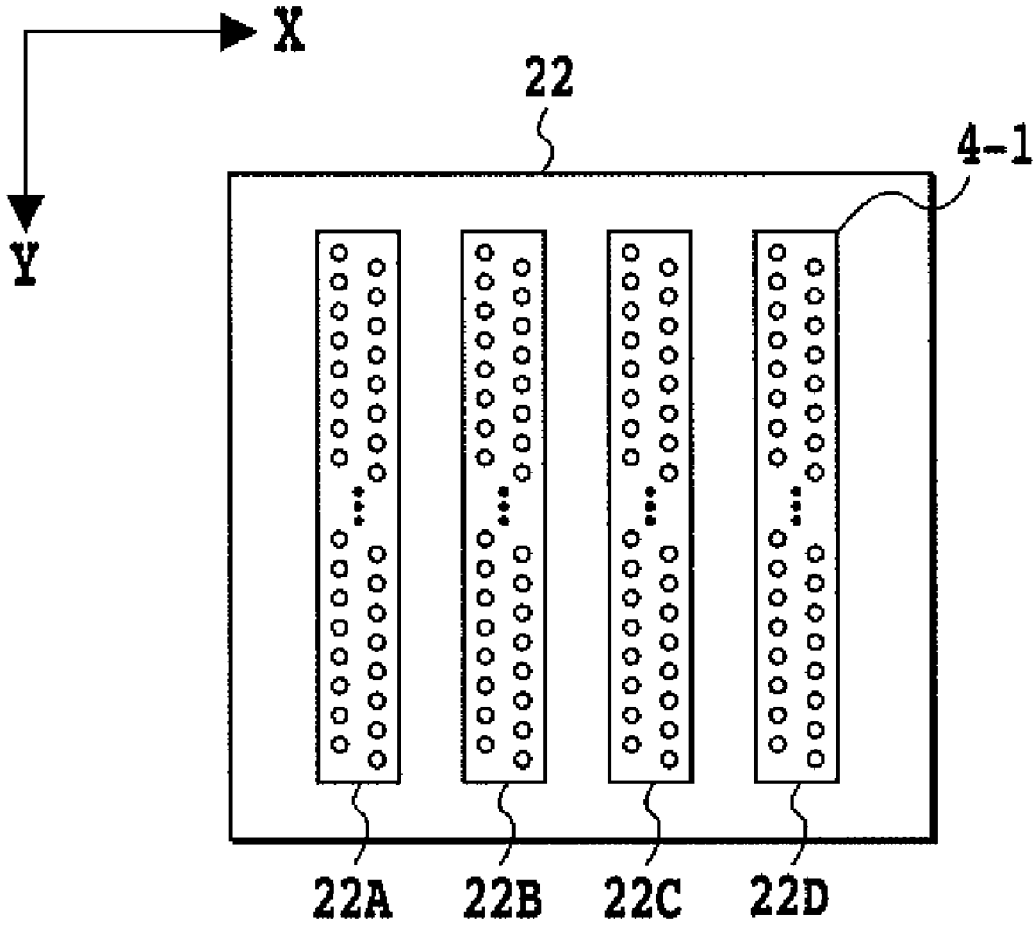
FIG. 4 illustrates an example of a print head used in the ink jet printing apparatus printing apparatus shown in FIG. 3.

The print head 22 shown in FIG. 4 has a structure in which the four nozzle arrays 22A, 22B, 22C, and 22D are arranged in a single print head constituting member. Each nozzle array includes a plurality of nozzles n arranged in a staggered manner in a fixed arrangement direction (direction Y) and with a high density. In this print head, each nozzle array has an arrangement density of 1200 dpi and each nozzle has an average amount of ink droplets of 2.5 pl.

When the print head 22 is attached to the carriage 32, a plurality of nozzles are arranged in a direction matching with the sub scan direction (direction Y) in which a print medium is transported. Thus, the scan direction of the print head 22 is the direction X orthogonal to this sub scan direction.

Figure 5:
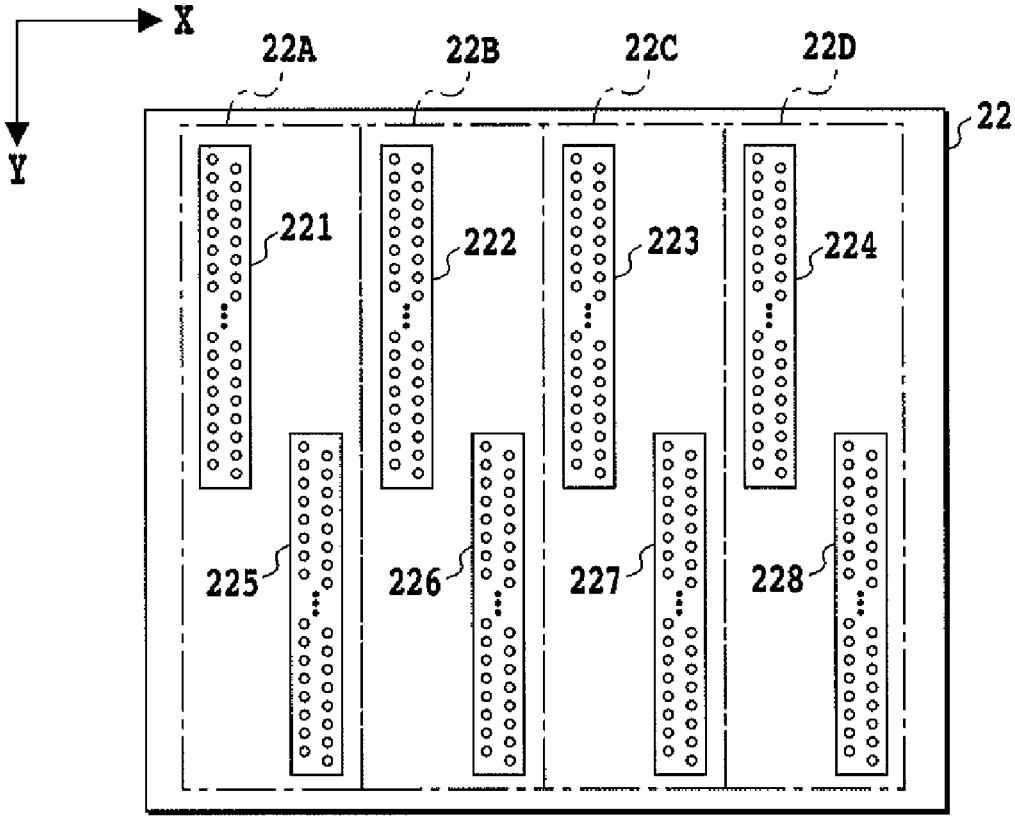
FIG. 5 illustrates another example of a print head used in the ink jet printing apparatus printing apparatus shown in FIG. 3.

On the other hand, the print head 22 shown in FIG. 5 has the same structure as that of the print head shown in FIG. 4 in which the four nozzle arrays 22A, 22B, 22C, and 22D are arranged in a single print medium constituting member.

However, in the print head 22 shown in FIG. 5, each nozzle array is a relatively long nozzle array provided by connecting two small nozzle arrays. Specifically, the nozzle array 22A consists of the small nozzle array 221 and the small nozzle array 225. The nozzle array 22B consists of the small nozzle array 222 and the small nozzle array 226. The nozzle array 22C consists of the small nozzle array 223 and the small nozzle array 227. The nozzle array 22D consists of the small nozzle array 224 and the small nozzle array 228. Each nozzle array includes two small nozzle arrays such that the end parts thereof are overlapped to each other.

Furthermore, each small nozzle array is structured such that a plurality of nozzles n for ejecting ink droplets in an average amount of 2.5 pl are arranged in a staggered manner in the direction Y, thereby providing the nozzles with a high arrangement density in the sub scan direction (direction Y). The print head 22 shown in FIG. 5 also has a nozzle arrangement density of each nozzle array of 1200 dpi.

In the print heads shown in FIG. 4 and FIG. 5, another structure also may be used in which each nozzle array is provided with a print head and the former and the latter are detachable to each other as shown in FIG. 3.

Next, an embodiment of a thinning-out divided printing which is a feature of the present invention will be described.

In this embodiment, a mask pattern having a low printing ratio region (high thinning-out ratio region) having a predetermined width and a high printing ratio region (low thinning-out ratio region) is used to thin-out to-be-printed data to distribute the to-be-printed data to the respective nozzles of a print head. This is one of characteristic structures of this embodiment.

First, the principle of the present invention found by repeated keen examinations by the present inventors will be described below.

In the serial-type ink jet printing apparatus printing apparatus as shown in FIG. 3, when the carriage 32 for scan the print head 22 has a low scan speed or when nozzles are arranged with a very low density of about 150 dpi, eddy flow caused in the nozzle arrays is weak. However, when the nozzles are arranged with a high density equal to or higher than 600 dpi and an image is printed with a high speed and a high printing ratio, strong eddy flow is caused.

This was confirmed by the experiment as described below. Specifically, according to the confirmed result by the experiment, the print head 22 and the print medium P have therebetween a distance of about 0.5 mm to about 3.0 mm and the main scan was performed at a high speed at which relative scan speed of the print head 22 and the print medium p exceeds 5 inch/s (sec). Then, when a print head is used in which nozzles for ejecting small ink droplets equal to or lower than 6 pl are arranged with a high density of about 600 dpi and when a region in which nozzle arrays simultaneously eject ink droplets has a wide width, strong eddy flow was caused to remarkably deteriorate an ink landing accuracy.

In this case, in the case of a print medium having a relatively rough surface (typical example of which is a plain paper), the fluctuation of an ink landing position to some extent has not so much impact on an image quality within a permissible range. However, when a print medium having small bleeding (e.g., coated paper, gloss paper) is printed, the fluctuation of an ink landing position is remarkable and thus is easily recognized as uneven density.

As a result of the repetition of the experiments as described above, it was confirmed that printing conditions through which remarkable image deterioration is caused in an ink jet printing apparatus printing apparatus are the conditions as described below, for example.

Specifically:

(1) nozzle arrays in the print head arranged with a density equal to or higher than 600 dpi and in the substantially one row (the term "the substantially one row" means to include the staggered arrangements shown in FIG. 3, FIG. 9, or the like);

(2) small ink droplets from a nozzle in an amount equal to or lower than 6 pl;

(3) the relative movement speed of the print head and the print medium (i.e., printing scan speed) equal to or higher than 5 inch/s; and (4) a distance between the print head and the print medium equal to or longer than 0.5 mm.

Furthermore, it was also confirmed that, the higher the printing ratio in one main scan is, the higher the image deterioration is. FIG. 9 schematically shows how ink droplets land during the scan.

Figure 9A:
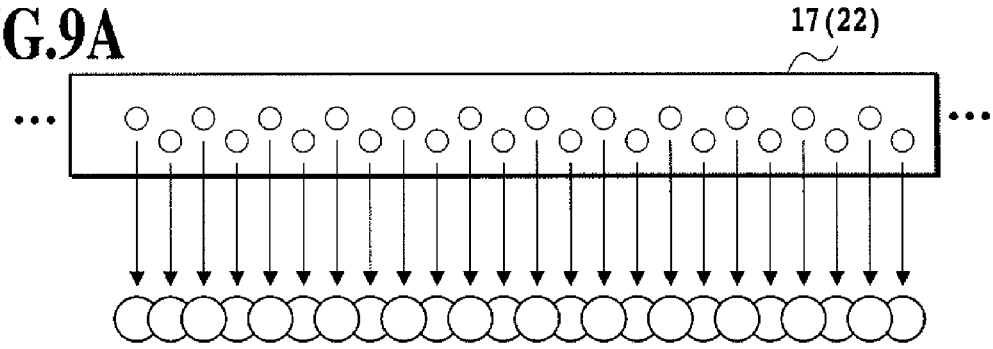
FIG. 9A to FIG. 9C explain the principle of the ink ejection operation in the embodiment of the present invention.

FIG. 9A shows the direction in which ink droplets fly and dots formed on a print medium when ink droplets are ejected from nozzle arrays arranged in the substantially one row with a density of 1200 dpi. The printing conditions during the eject were determined as described below.

The relative movement speed of the print head and the print medium (printing scan speed) was determined to be 2.5 inch/s, which is a very slow speed. The driving frequency of each nozzle was set to be 3 kHz. The printing ratio was set to be 100% (in which all nozzles in the nozzle arrays eject ink). The distance between the print head and the print medium was set to be 0.4 mm.

Under the printing conditions as described above, ink droplets ejected from the respective nozzle arrays flied in the substantially one direction as shown by the arrow in FIG. 9A. Thus, the ink landing positions of the ink droplets were prevented from being fluctuated, thus providing an image having no uneven density.

Figure 9B:
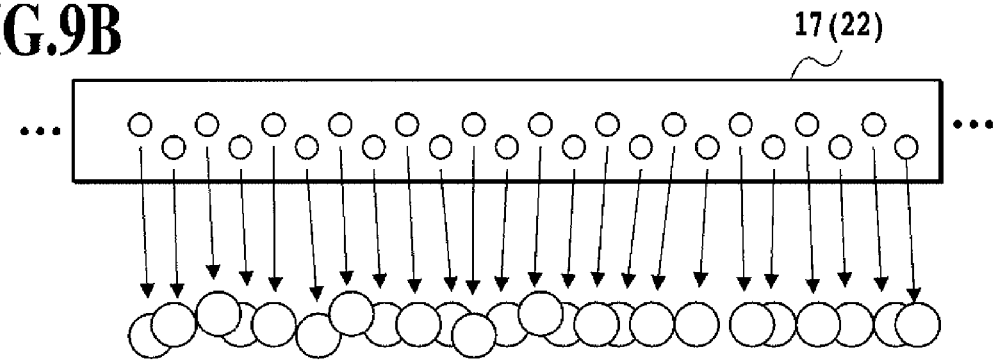

On the other hand, FIG. 9B shows a case of the printing conditions of a high speed of 15 inch/s and a distance between the print head and a print medium of 1.5 mm. The other conditions in FIG. 9B for ejecting ink droplets are the same as those of FIG. 9A.

In this case, eddy flow was caused between the print head and the print medium to cause ink droplets ejected from the nozzles to fly in non-uniform directions, causing fluctuated ink landing positions. The fluctuated ink landing positions caused an image including uneven density and undesirable white and black stripes.

Figure 9C:
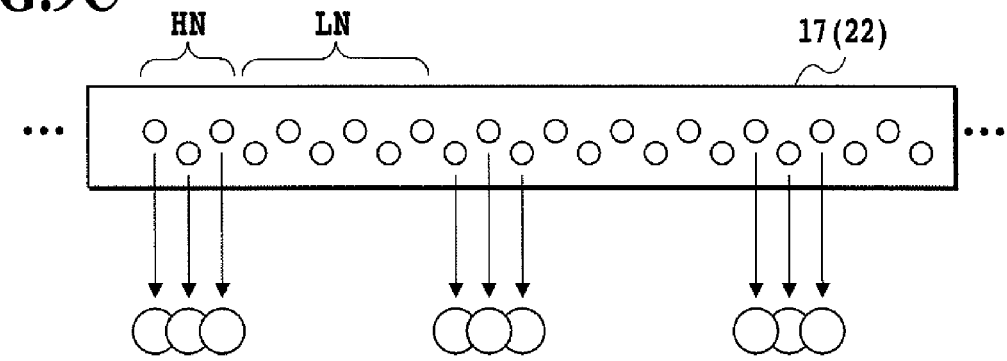

FIG. 9C shows a case in which the same nozzle arrays as those of FIG. 9A and FIG. 9B include the region HN having a width of three nozzles and the region LN having a width of six nozzles that are arranged alternately. In this arrangement, the region HN having a width of three nozzles is a high printing ratio region for the printing with a high printing ratio and the region HN having a width of six nozzles is a low printing ratio region for the printing with a low printing ratio. In this case, no fluctuation of landing position of ink droplets was caused even when the printing scan speed was set to be a high speed of 15 inch/s.

Figure 10A:
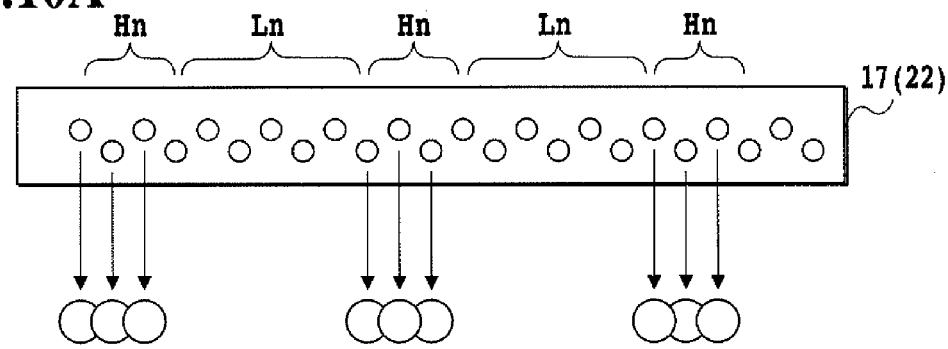
FIG. 10A to FIG. 10D show examples of the ink ejection operation in the embodiment of the present invention and how ink droplets land.
Figure 10B:
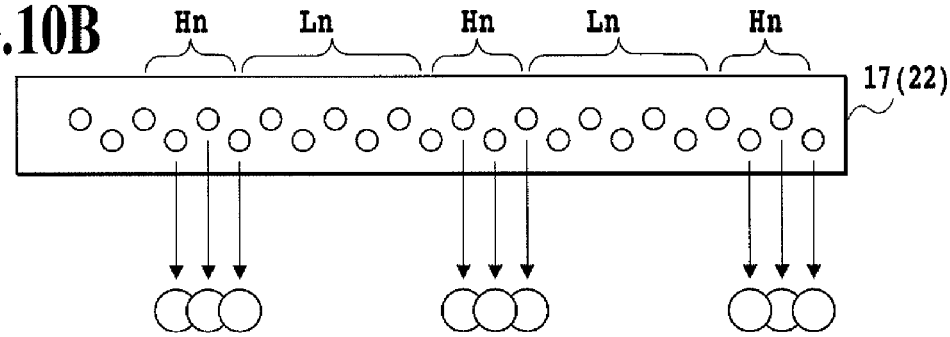
Figure 10C:
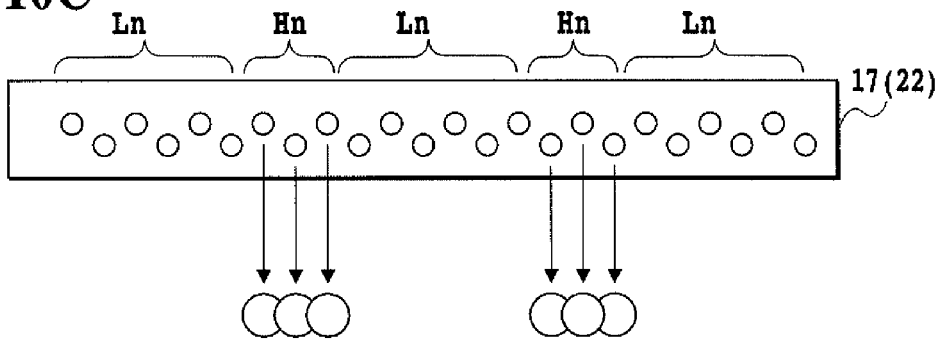
Figure 10D:
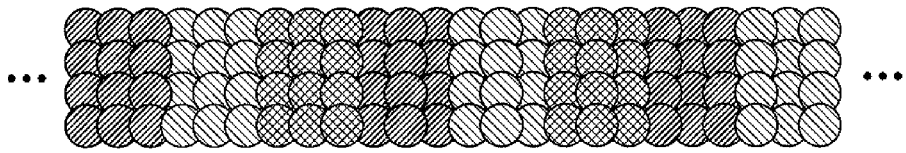

FIGS. 10A to 10 D show a case in which nozzle arrays arranged with a density of 1200 dpi include, as in the above-described case of FIG. 9C, the low printing ratio region Ln having a width of six nozzles and the high printing ratio region Hn having a width of three nozzles are alternately provided. In this arrangement, three scan printings are repeated to form an image. FIG. 10A shows how ink droplets ejected by the first scan fly and land to a print medium. FIG. 10B shows how ink droplets ejected by the second scan fly and land to the print medium. FIG. 10C shows how ink droplets ejected by the third scan fly and land to the print medium. FIG. 10D shows how dots are formed by the three scans showed by FIGS. 10D to 10C.

The arrangements shown in FIGS. 10A to 10D also do not cause the fluctuation of ink landing positions, providing a favorable image. Although the examples shown in FIGS. 10A to 10D showed a case in which the low printing ratio region does not eject ink for convenience, it has been confirmed that the failure to eject ink is not necessary for the printing conditions and the same effect also can be obtained by a low printing ratio with a low ink eject ratio. Although the examples shown in FIGS. 10A to 10D showed a case in which the high printing ratio region eject ink with a 100% printing ratio for convenience, the printing ratio also can be changed in accordance with the eject state of a low printing ratio. It is noted that the magnitude of the printing ratio within a nozzle array depends on the magnitude of the thinning-out ratio of the mask pattern M for thinning out to-be-printed data. Thus, the thinning-out ratio of the mask pattern corresponding to the high printing ratio region Hm within the nozzle array is set to be low and the thinning-out ratio of the mask pattern corresponding to the low printing ratio region Lm within the nozzle array is set to be high.

FIG. 11 to FIG. 15 are a conceptual diagram illustrating the thinning-out processing to-be-printed data so that the nozzle array includes the high printing ratio regions Hn and the low printing ratio regions Ln arranged alternately.

Figure 11:
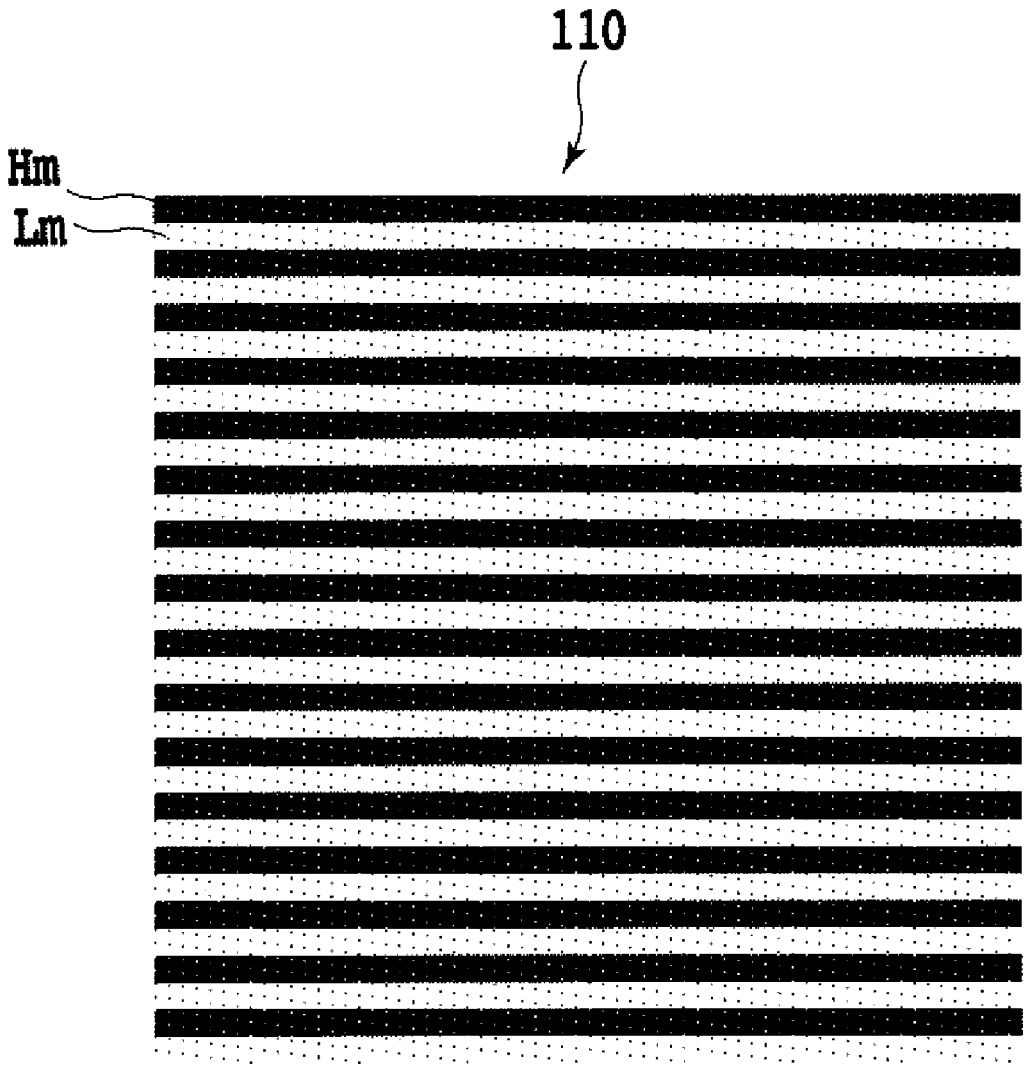
FIG. 11 illustrates an example of a mask pattern in the embodiment of the present invention.

The mask pattern 110 shown in FIG. 11 is a pattern in which the high printing ratio regions Hn and the low printing ratio regions Ln are arranged alternately. The low printing ratio region (high thinning-out ratio region) is a region in which to-be-printed data binarized by the above-described image processing section 76 is thinned-out with a high thinning-out ratio. The high printing ratio region (low thinning-out ratio region) Hm is a region in which the binarized to-be-printed data is thinned-out with a low thinning-out ratio. The respective regions Lm and Hm are reed-shaped regions extending in a straight line along the main scan direction.

It is noted that the term "mask pattern thinning-out ratio" is a ratio at which a non print areas showing to-be-thinned-out positions occupy in all areas of a mask pattern composed by predetermined a print permit areas and non print permit areas. On the other hand, the term "mask pattern printing ratio" is a ratio at which print permit areas occupy in all areas of a mask pattern composed by predetermined print permit areas and non print areas and has an opposite meaning to "mask pattern thinning-out ratio. Thus, the low thinning-out ratio region is synonymous with the high printing ratio region and the high thinning-out ratio region is synonymous with the low printing ratio region. The mask pattern thinning out ratio and mask pattern printing ratio are predetermined values and neither is influenced by image data.

The use of this mask pattern 110 can provide, even when the print head having nozzle arrays in which nozzles are arranged with a high density as shown in FIGS. 2, 4, and 5 is used to perform a printing by a high-speed scan, favorable flying state of the ink droplets as shown in FIG. 9C and FIGS. 10A to 10D. As a result, a favorable image having small ink landing error can be formed.

For example, when the mask pattern 10 is used to thin-out to-be-printed data, the nozzle arrays are in the state as shown in FIG. 9C and FIGS. 10A to 10D. Specifically, the nozzle arrays are alternately divided to the high printing ratio regions Hn in which the number of ejected ink droplets tends to increase and the low printing ratio regions Ln in which the number of ejected ink droplets tends to decrease. In other words, the width of the high printing ratio region Hn in the nozzle array direction is divided by the low printing ratio region Ln. As a result, the level of eddy flow caused between the print head and the print medium can be reduced and the fluctuation of ink landing positions can be eliminated over the entire nozzle arrays, thus providing an image having a favorable quality.

The following section will describe how the present inventor has assumed a reason (mechanism) of the above-described fluctuation of ink landing positions by the use of the mask pattern in which a high thinning-out ratio region and a thinning-out ratio region are alternately arranged.

In order to complete an image with a short time in a serial-type ink jet printer or in a full-line-type ink jet printer, a high-speed relative scanning must be performed with a high printing ratio. Then, the disturbed air current is caused in a space between a recording head and a printing medium as described above. An amount and a manner of this disturbed air current largely depend on a scanning ratio or a printing ratio. The above disturbed air current is suppressed by providing a distribution of thinning-out ratios in a mask pattern as in the present invention.

Specifically, a high air current is caused from the top of a print head to the subsequent head by a high-speed relative scanning between a print head and a print medium. This is the above-described air current caused between a print head and a print medium. In a direction substantially orthogonal to this air current, ink droplets are ejected from the print head having a high density. This ejected ink with a high density disturbs the above air current. Specifically, air current is caused to bypass the wall of the ejected ink having a high density. Then, this bypass air current changes a direction in which ink droplets are ejected, leading to a deviation of ink landing positions.

However, when the mask pattern is used in which thinning-out ratios in a nozzle arrangement direction are alternately arranged to provide an order of high, low, and high thinning-out ratios, a space is caused in the wall of the ejected ink having a high density. Specifically, the space is at a position corresponding to a high thinning-out ratio region of the mask pattern. Thus, the wall of the ejected ink includes alternate spaces in the nozzle arrangement direction. Then, air current disappears from this space to proportionally reduce the bypass air current. Consequently, the deviation of the ink landing positions due to this bypass air current is suppressed.

In an image formed by one scan by the print head, there is a tendency where an region printed with a high printing ratio and an region printed with a low printing ratio in accordance with the mask pattern shown in FIG. 11 are alternately provided.

In the serial-type ink jet printing apparatus printing apparatus as shown in FIG. 3, a plurality of complementary mask patterns in which the positions of high printing ratio regions and low printing ratio regions are changed are prepared. Then, one of these mask patterns is switched for each scan to be supplied to a print head for a single color. This can provide an image of the same color to the same scan region by a plurality of printing scans.

When the mask pattern is used to perform a printing operation by the above mask pattern in the full-line-type printing apparatus printing apparatus as shown in FIG. 1, a line head having a plurality of nozzle arrays for ejecting the same color ink is provided and a plurality of types of complementary mask patterns are prepared as in the case of a serial printer. Then, the printing operation is performed by supplying image data thinned out by each mask pattern to each nozzle array. As a result, substantially a plurality of scans are performed to the same printing region, thereby completing an image of the same color.

Figure 12:
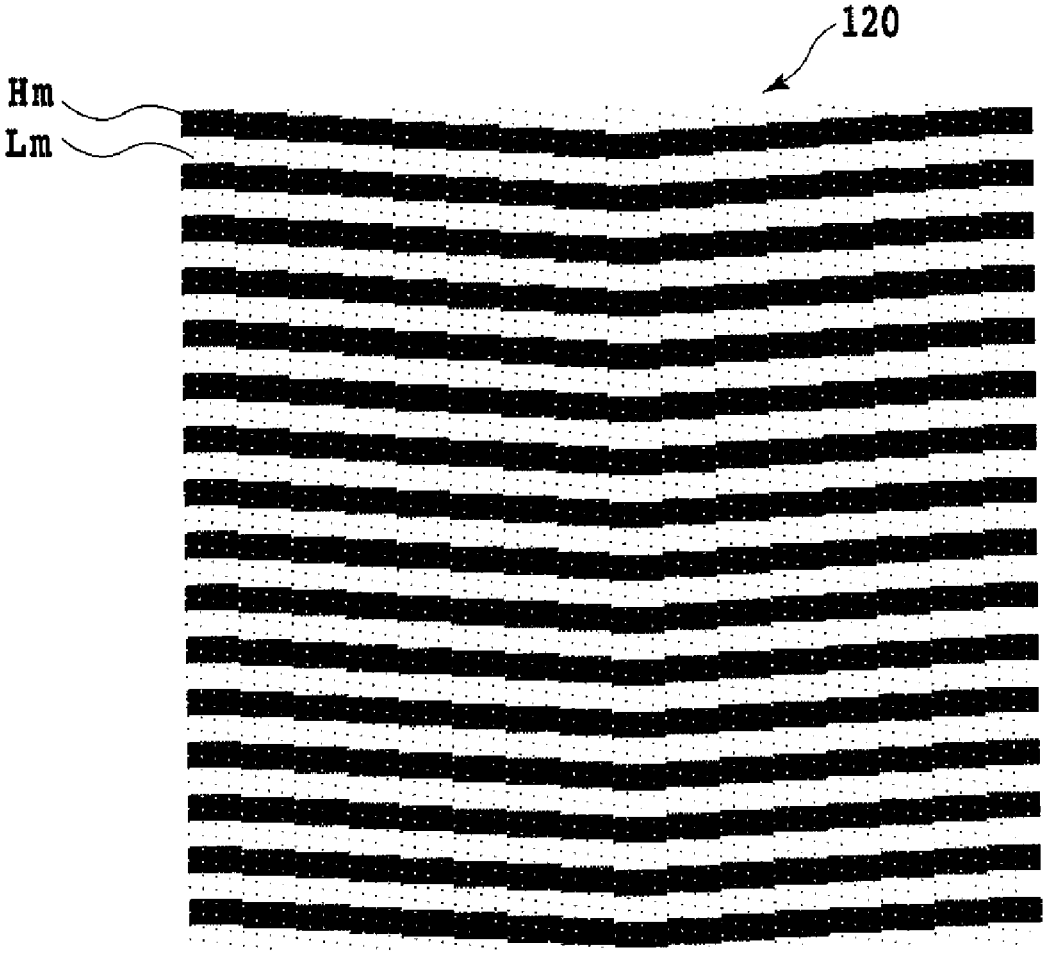
FIG. 12 illustrates another example of the mask pattern in the embodiment of the present invention.

The mask pattern 120 shown in FIG. 12 is a pattern similar to the mask pattern 110 shown in FIG. 11 in which reed-shaped low printing ratio regions Lm and high printing ratio regions Hm are provided alternately. However, in the mask pattern shown in FIG. 12, the boundary between the high printing ratio regions Hm and the low printing ratio regions Lm is continuously changed (or draws an undulating line) in the direction in which nozzles are arranged. In this case, the deterioration of an image due to air current can be prevented as in the case of FIG. 11. Furthermore, one nozzle in a nozzle array can perform a printing by a high printing ratio and a printing by a low printing ratio in one scan and thus the frequencies at which nozzles are used can be equalized. Therefore, this mask pattern 120 can equalize the service lives of the respective nozzles, thus advantageously increasing the service life of the entire print head. The above design in which the respective reed-shaped regions are arranged to draw an undulating line also can reduce stripe uneven density among the respective regions.

When the print head is attached at a slant, an image to be formed may include stripe-like uneven density in general. However, this problem is solved by increasing an accuracy at which the head is attached. In the case of the full-multi-type line printer in particular, the head is fixed to the print apparatus to transport a to-be-printed medium. Thus, the full-multi-type line printer has less influence on the printing than in the case of the serial type printer.

Figure 13:
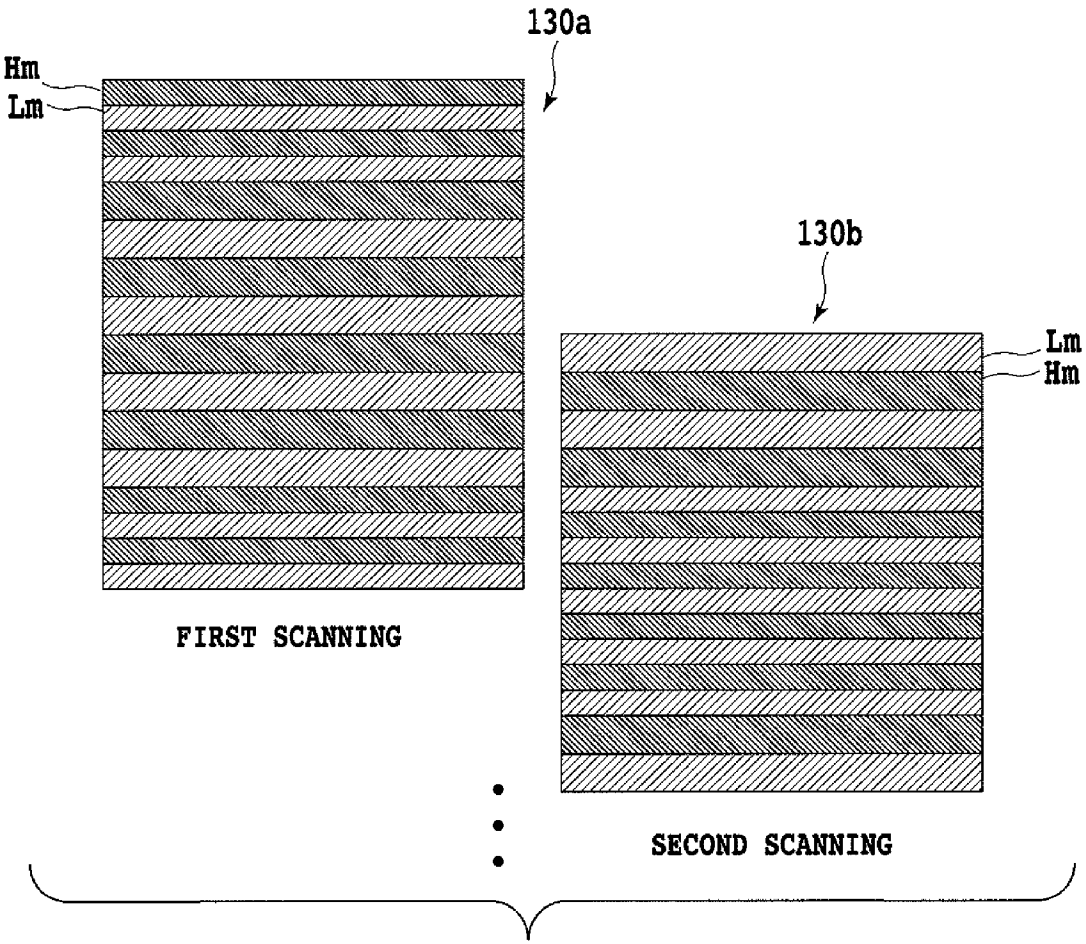
FIG. 13 illustrates another example of the mask pattern in the embodiment of the present invention.

FIG. 13 shows an example in which the mask pattern 130 in which the widths of the low printing ratio regions Lm and the high printing ratio regions Hm in the nozzle array direction are changed in an irregular manner. FIG. 13 shows a mask pattern by which an image for a single printing region is completed by two printing scans. In FIG. 13, the reference numeral 130*a* denotes a mask pattern used for the first scan and the reference numeral 130*b* denotes a mask pattern used for the second scan, respectively.

This case also can reduce the eddy flow caused between the print head and the print medium if the width of the high printing ratio region is equal to or lower than a predetermined region width. Thus, a favorable image can be formed. When a nozzle array has a relatively long length, the space between the nozzle array and the print medium has air currents distributed to correspond to positions in the nozzle array. Thus, the width of the high printing ratio area is preferably designed to correspond to the position in the nozzle array.

Figure 14:
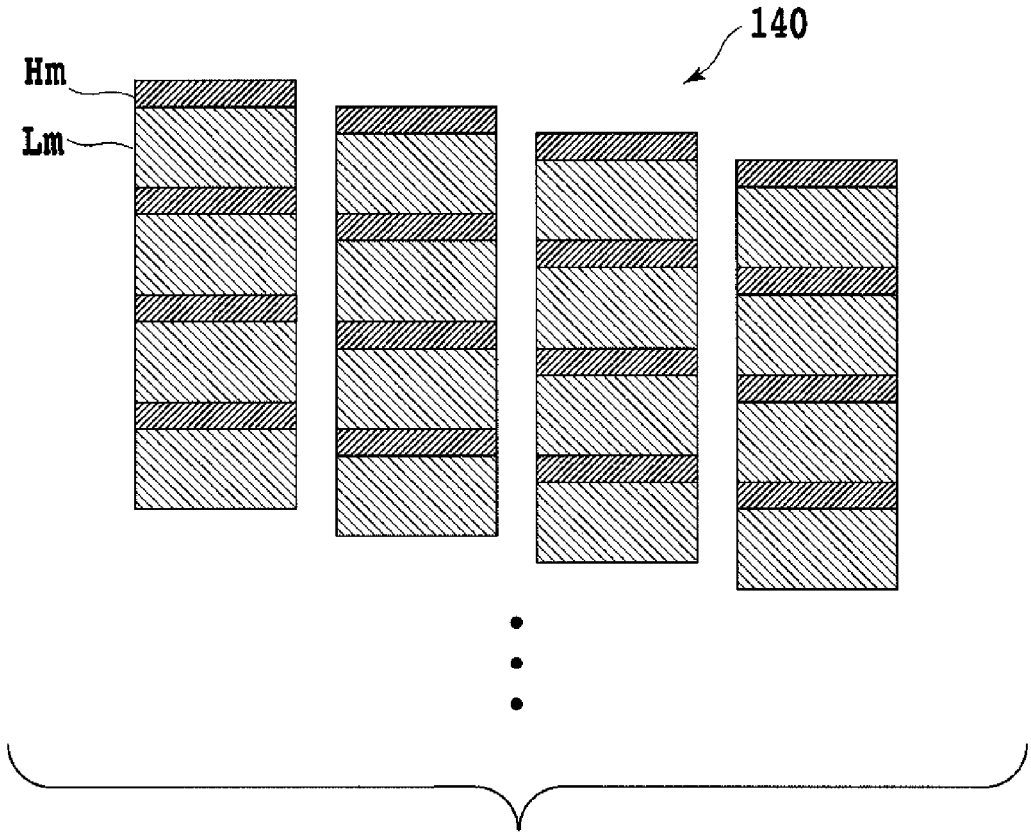
FIG. 14 illustrates another example of the mask pattern in the embodiment of the present invention.

FIG. 14 shows a mask pattern used when an image is completed by four printing scans. This case also can suppress adverse impact by air current if the width of the high printing ratio region is equal to or lower than a predetermined region width. Thus, a favorable image can be formed.

Figure 15:
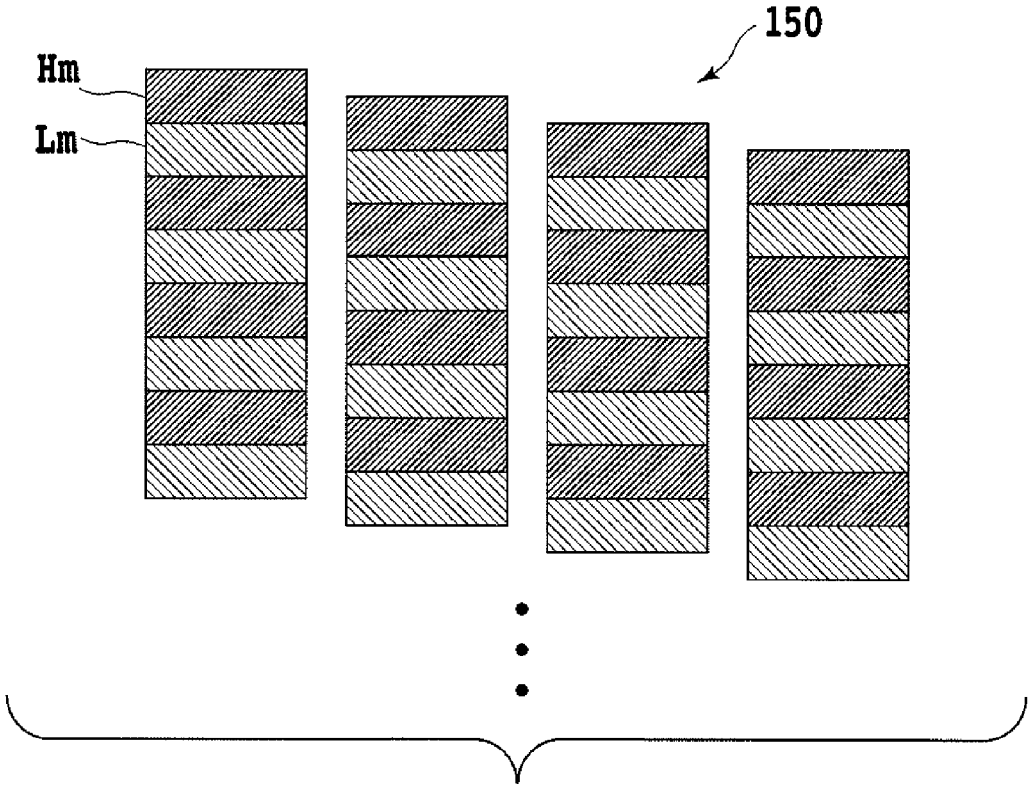
FIG. 15 illustrates a mask pattern in which the width of the high printing ratio region of the mask pattern shown in FIG. 14 is increased.

When a printing to a single printing region is completed by four scans (i.e., when the printing with a 100% printing ratio is performed) and when each scan is printed with an equal printing ratio, the printing ratio in the respective scans is 25%. Thus, influence by eddy flow to ink droplets may be reduced even without the use of the mask pattern as described above in which the width of the high printing ratio region is set to be extremely small. However, the wide width of the high printing ratio region as shown in FIG. 15 is not desirable because this tends to cause uneven density with a pitch that causes the uneven density to be easily visually recognized.

Furthermore, in a case where a number of printing scans are used to complete an image, the printing ratio in one scan is reduced due to the above-described reason to cause small eddy flow. Thus, this case may not require the reed-shaped high printing ratio region as described above. Specifically, the present invention is effective when a matrix for printing has a resolution equal to or higher than 600 dpi and an image is completed by about four scans or less. The present invention is remarkably effective when an image is completed by two scans. This effect is provided not only to the serial-type ink jet printing apparatus printing apparatus but also to the full-line-type ink jet printing apparatus printing apparatus as described above in which two or more nozzle arrays for ejecting the same ink are arranged and the respective nozzle arrays are used to complete an image.

As described above, by repeated keen examinations by the present inventors, it was confirmed that an effective configuration is that a high printing ratio region and a low printing ratio region are alternately provided for a single printing scan regardless of whether they are arranged in a cyclic or noncyclic manner and the high printing ratio regions are arranged to have a width equal to or lower than a predetermined region width. Specifically, the experiments showed that the printing ratio set as described above can reduce, even when a print head in which nozzles are arranged with a high density is used to perform a high-speed printing, eddy flow caused between the print head and the print medium to reduce the fluctuation of ink landing positions over the entire nozzle arrays. The experiments also showed that the increased width of the reed-shaped high printing ratio region causes eddy flow in the high printing ratio region, preventing the image quality from being maintained. Furthermore, from the viewpoint of reducing the influence by eddy flow, the width of the reed-shaped low printing ratio region is desirably wide. However, an increased width of the low printing ratio region requires an increased number of printing scans for completing an image. Thus, the width of the low printing ratio region is desirably set to have an appropriate width. When an image is completed by two printing scans for example, the total of the low printing ratio regions in the nozzle array is required to be the total of the high printing ratio regions. The image is also required to be completed by being divided and thinned-out. Thus, the present invention requires a plurality of printing scans (a plurality of scans by multipass or a plurality of scans by a number of heads) to be performed so that the total of the widths of the low printing ratio regions is equal to the total of the widths of the high printing ratio regions.

Other results confirmed by the experiments will be described below.

A print head having a nozzle arrangement density of 600 dpi was used and the distance between the print head and a print medium was set to be 1.5 mm. This print head was used to perform a printing operation with a scan speed of 15 inch/s.

In this case, a reed-shaped thinning out mask pattern was used in which the high printing ratio region Hm having the width of 2.4 mm for 64 nozzles and the low printing ratio region Lm having 2.4 mm in which substantially no printing is performed were provided. In this case, ink droplets ejected form the high printing ratio region Hm in the nozzle array showed fluctuated ink landing positions due to eddy flow.

When the stripe width of the high printing ratio region Hm was gradually reduced to the width of 1.2 mm corresponding to 32 nozzles, uneven density of an image due to eddy flow was reduced to a level causing no problem in the image quality. Thus, it was clarified that the stripe width of the high printing ratio region Hm equal to or lower than 1.2 mm can provide a high-speed printing while suppressing the deterioration of image in a general ink jet printing apparatus.

Another experiment was performed with printing conditions in which the scan speed was 5 inch/s to 50 inch/s, the distance between the print head and the print medium was 0.5 mm to 3.0 mm, and the volume of ejected ink droplets was 6 pl or less. In this case, the high printing ratio region set to have a very small stripe width as described above could suppress the deterioration of the image. The effect of reducing the deterioration of the image as described above was obtained not only in a full-line-type ink jet printing apparatus printing apparatus in which two or more nozzle arrays are provided and the relative movement between the line head and the print medium provides a printing operation but also in a serial-type ink jet printing apparatus printing apparatus in which a printing scan with two passes or more is performed.

When the width of the high printing ratio region was increased to be more than 1.2 mm, generation of eddy flow also could be reduced to a certain level. However, stripe uneven density with a predetermined pitch tended to be remarkable, failing to provide a favorable image quality.

Specifically, when an image is completed by three printing scans to a single printing region, the printing ratio in each scan is one third of the total three printing scans. When an image is completed by four printing scans to a single printing region, the printing ratio in each scan is one fourth of the total four printing scans. This reduces eddy flow caused in the respective scans. In other words, it is possible to provide a favorable printing result even when the width for a high printing ratio set by a mask pattern exceeds 1.2 mm. For example, the maximum printing ratio for each printing scan in the printing with 4 passes corresponds to the half of that in a case where an image is completed by two printing scans. Thus, an influence by eddy flow can be reduced even when the predetermined width of the high printing ratio region is increased to 2.4 mm at the maximum. However, the width of the high printing ratio region exceeding 1.2 mm is not desirable because it causes stripe uneven density with a cycle that causes the unevenness to be easily visually recognized.

Some types of printing media showed an influence by minute eddy flow when being subjected to a high-speed printing. For example, when a gloss paper PR101 made by Canon Inc. was subjected to the high-speed printing, an image on the paper sometimes showed an influence by minute eddy flow. However, by repeated keen examinations by the present inventors, it was found that a pseudo half-toning processing method using the area coverage modulation method in which an image is represented by shape units was effective for reducing the influence by minute eddy flow as described above. Specifically, it was found that the pseudo half-toning processing method using a binarization processing with a concentrated area coverage modulation method was effective for this purpose. When this method is used, it was clear that an image quality can be improved by providing the width of a stripe of a high printing ratio region to be an integral multiple of shape units of a dot concentrated-type image.

Next, how to prepare to-be-printed data in an embodiment of the present invention will be described.

Figure 8:
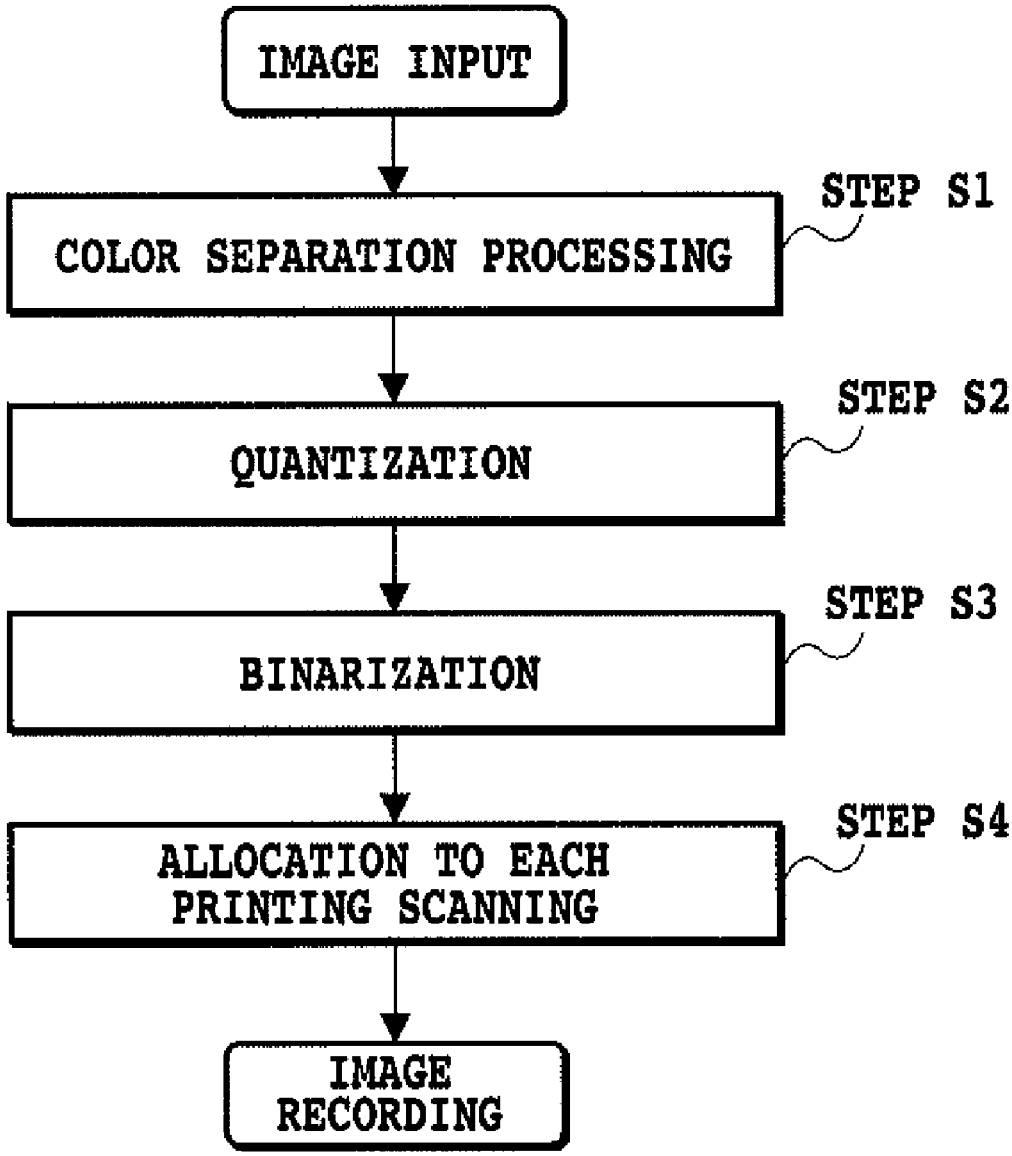
FIG. 8 is a flowchart illustrating the image processing in the embodiment of the present invention.

To-be-printed data using a print head is prepared by a method using a general ink jet printer. In this embodiment, inputted multivalued image data (e.g., 8 bit RGB data) is converted (color separation) to the respective pieces of multivalued image data (e.g., 8 bit CMYBk data) corresponding to the respective colors of heads (Step 1) as shown in FIG. 8. Thereafter, the respective pieces of multivalued data subjected to the color separation is quantized by the error diffusion method to K values (e.g., 17 value) (Step 2). Then, the dot arrangement pattern corresponding to the quantized K values is selected for binarization to generate to-be-printed binary data (Step 3). Thereafter, the to-be-printed binary data is divided by the thinning out mask pattern and the divided data are allocated to the print head (Step 4). Alternatively, the multivalued data subjected to the color separation also may be directly binarized without performing quantization processing so that this binarized data is used as to-be-printed data for driving the print head.

Figure 26:
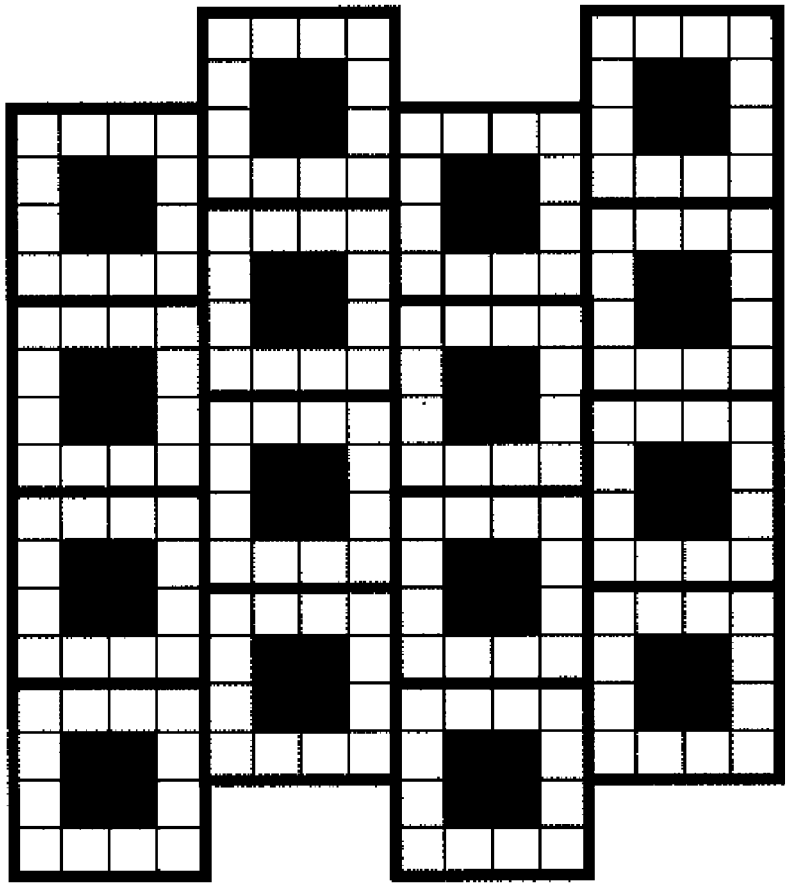
FIG. 26 is a schematic view illustrating an example of image data printed by the dot concentrated area coverage modulation method in the embodiment of the present invention.

FIG. 26 shows an example of a processing for converting the respective colors of multivalued data to to-be-printed binary data. In this example, the respective colors of multivalued data which are quantized into 17-valued are converted into a dot concentrated area coverage modulation pattern in which a printing matrix consisting of 4×4 cells (which also may be called as dot arrangement pattern). The converted data is allocated to each pixel, thereby obtaining binary data.

The dot arrangement pattern shown in this example is a pattern generated for the purpose of constituting an image of half-tone dots. The cells in FIG. 26 are virtually shown in order to clarify the positions at which the respective dots are formed and these cells have the resolution of 1200 dpi. The One cell corresponds to one area in a mask pattern.

Figure 31:
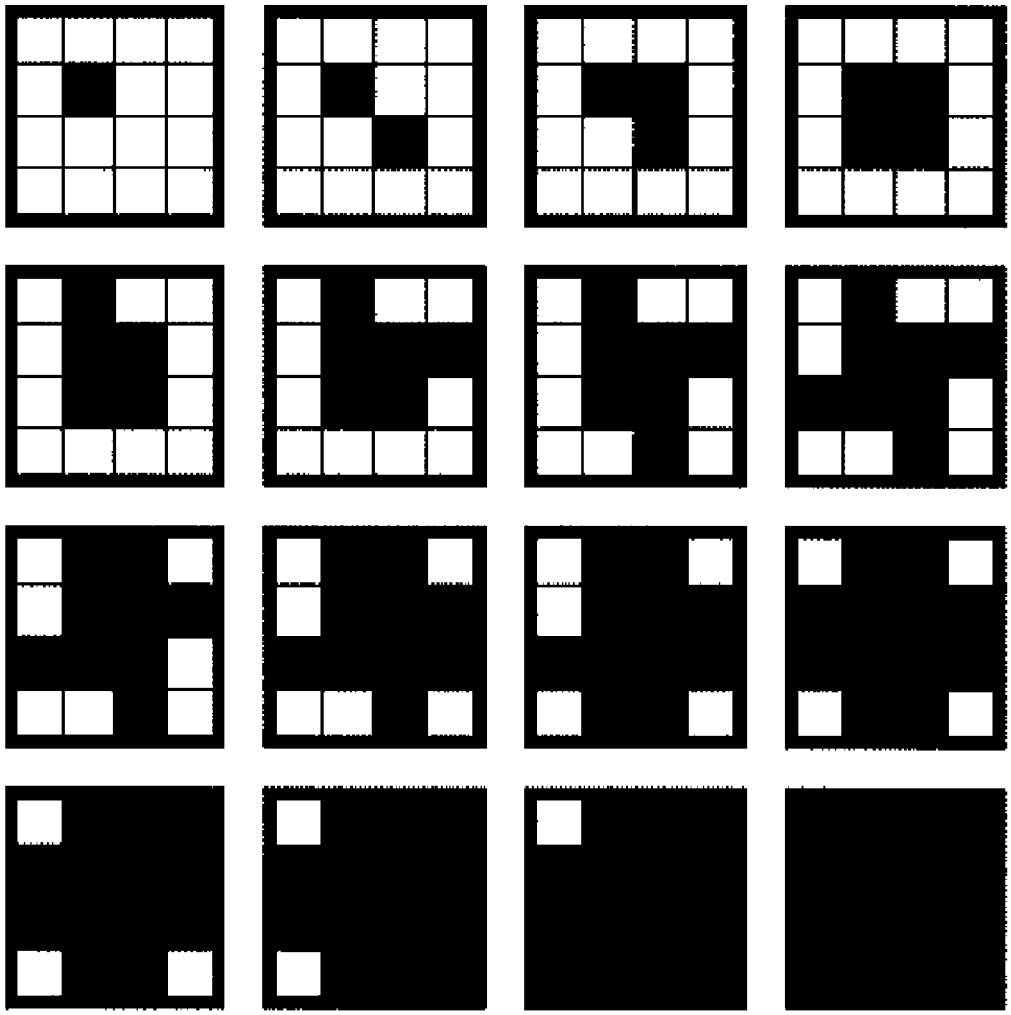
FIG. 31 illustrated the dot arrangement pattern corresponding to the respective gradation values according to the dot concentrated area coverage modulation method.

FIG. 31 shows an example of patterns representing 17 gradations in the 4×4 printing matrix by the dot concentrated area coverage modulation method. The shown patterns are patterns in which, whenever a gradation value to be represented increases by one, a dot is printed at a cell closer to the center part. FIG. 31 shows only 16 patterns to superficially show that only 16 patterns exist. However, in addition to these patterns, a pattern for the gradation value of 0(zero) exists in which no dots are formed at all. Thus, the total of 17 patterns obtained by adding the 16 patterns to the one pattern for the gradation value of 0 (zero) realize 17 gradations.

Figure 27:
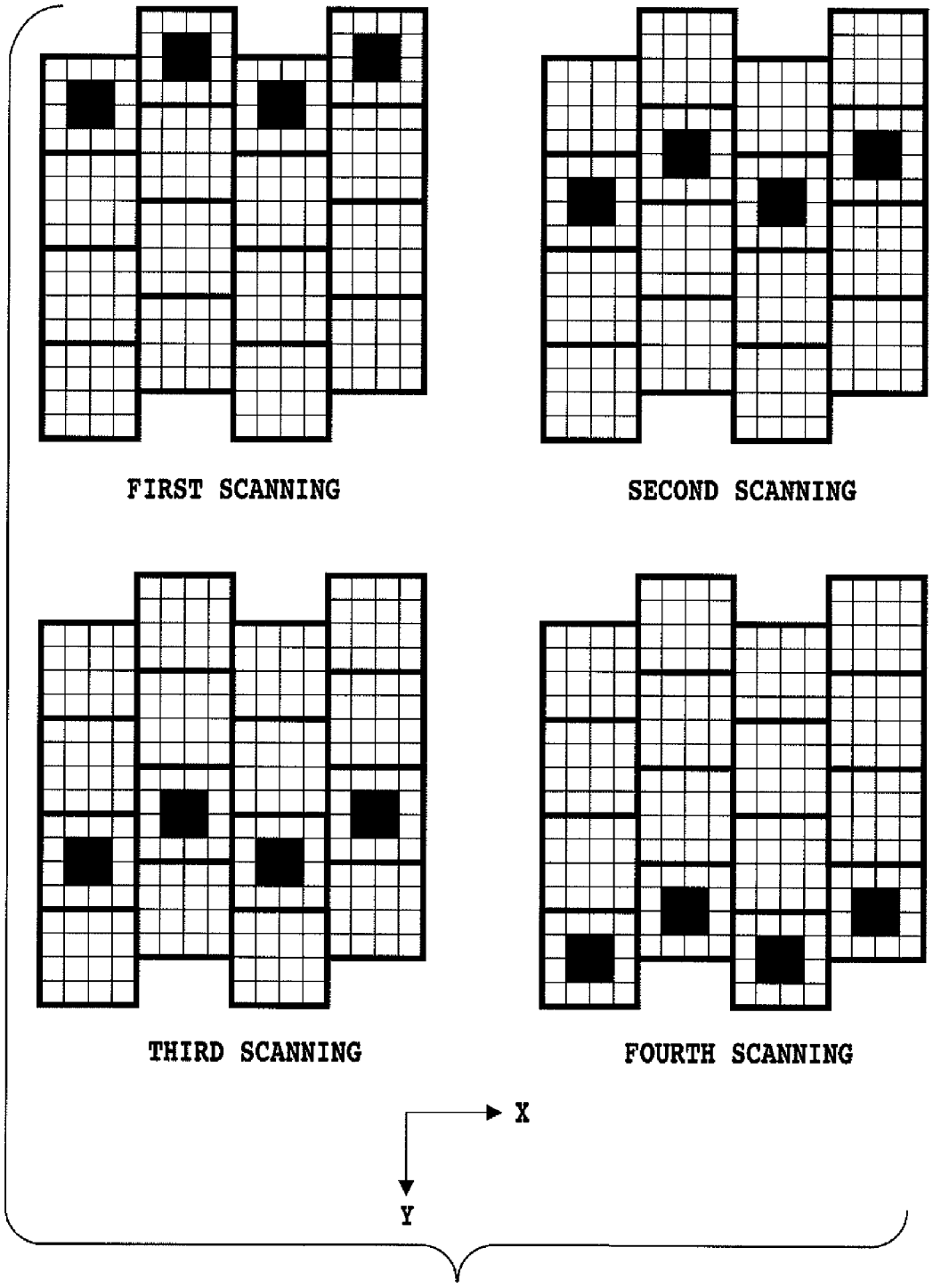
FIG. 27 is a schematic view illustrating the image data shown in FIG. 26 that is divided so as to correspond to the respective scans of a divided printing.

FIG. 27 shows a state in which the image data represented by the dot concentrated area coverage modulation pattern shown in FIG. 26 is divided by the respective printing scans for printing. In FIG. 27, an image shape unit corresponding to one pixel is formed by a printing matrix consisting of 4×4 cells and the entire image is provided by repeating this shape unit. The shown direction X shows a direction in which the print head is scanned on the print medium while ejecting ink droplets and the shown direction Y shows a direction in which nozzle arrays provided in the print head are arranged. In FIG. 27, blacked-out parts in cells represent data for which ink droplets are ejected.

When the full-line-type ink jet printing apparatus printing apparatus shown in FIG. 1 or the serial-type ink jet apparatus shown in FIG. 3 is used to perform a printing operation, the image data shown in FIG. 26 is divided in each scan by the mask pattern in this embodiment.

In this case, a print head having the first to fourth nozzle arrays for ejecting the same color is prepared and each nozzle array is used to sequentially perform the printing operation. Specifically, the first nozzle array, which is positioned at the uppermost stream of the scan direction (direction in which a print medium is transported), is used to print the pattern data shown in FIG. 27A (the first scan). Next, the second nozzle array is used to print the pattern data shown in FIG. 27B (the second scan). Then, the third nozzle array is used to print the pattern data shown in FIG. 27C (the third scan). Finally, the fourth nozzle array is used to print the pattern data shown in FIG. 27D (the fourth scan). By the above process, an image for one color is completed.

When the serial-type ink jet printing apparatus printing apparatus shown in FIG. 3 is used to print the image data shown in FIG. 26, such a print head is used in which two nozzle arrays for printing the same color are arranged left and right (left row and right array). These nozzle arrays are used to print an image by two main scans. Specifically, the first main scan uses the left array to print the paten data shown in FIG. 27A (the first scan) and uses the right array to print the paten data shown in FIG. 27B (the second scan). Next, the second main scan uses the left array to print the paten data shown in FIG. 27C (the third scan) and uses the right array to print the paten data shown in FIG. 27C (the fourth scan). By the above process, an image for one color is completed.

Figure 28:
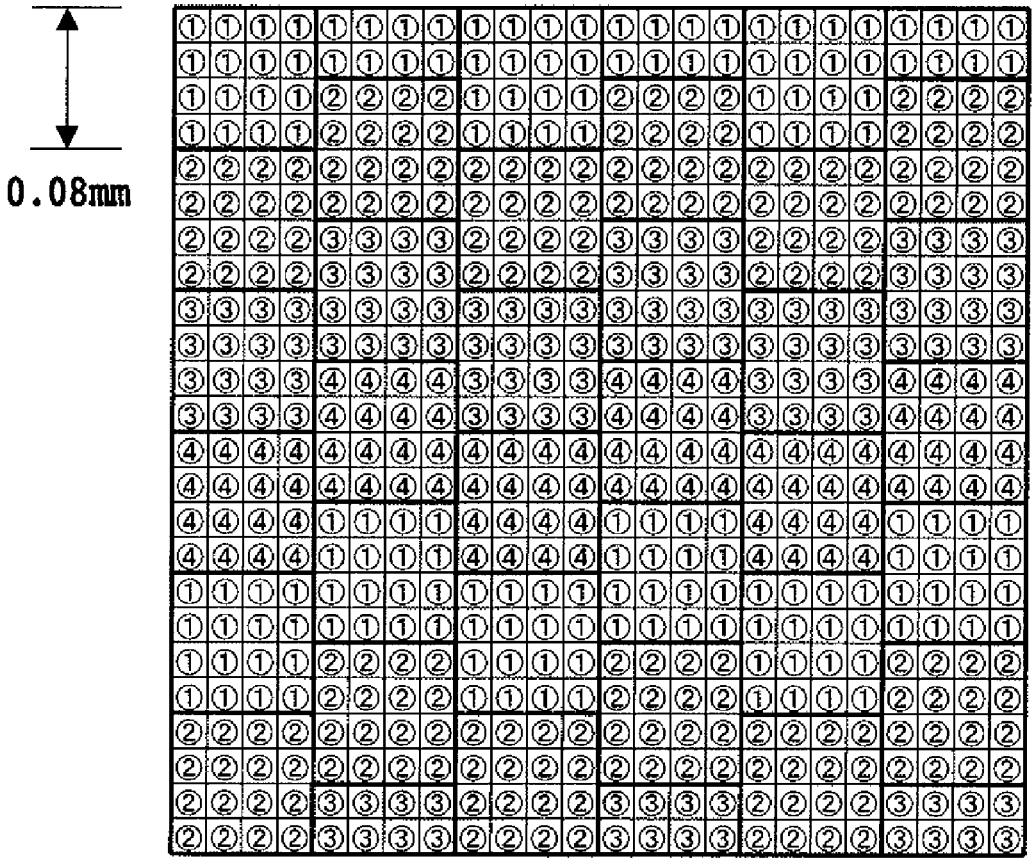
FIG. 28 illustrates a mask pattern for dividing the image data shown in FIG. 26 to the respective pieces of image data shown in FIG. 27.

FIG. 28 shows an example of the mask pattern M for dividing the image data as described above. In FIG. 28, the circled numbers 1, 2, 3, and 4 show the positions that can be printed by the first scan, the second scan, the third scan, and the fourth scan of FIG. 27, respectively. This mask pattern can be used to perform the divided printing as described above to allow any of the full-line-type and serial-type ink jet printing apparatus printing apparatuses to reduce the level of eddy flow caused between the print head and the print medium. This can maintain, with a high accuracy, the position to which ink droplets land, thus providing an image having a high quality.

As described above, in the case of any type of ink jet printing apparatus printing apparatus, printing is performed for each region for a shape unit having a width of 0.08 mm (high printing ratio region). Furthermore, among regions having a width of shape units to be simultaneously printed, a region having a width for three shape units in which no printing is performed (width of 0.24 mm) exists (low printing ratio region). Thus, eddy flow caused between the print head and the print medium is reduced significantly and positions to which ink droplets land are maintained with a high accuracy. Furthermore, in the mask pattern M shown in FIG. 28, the respective shape units neighboring to one another in the main scan direction are arranged such that shape units for two dots are dislocated in the up-and-down direction in the sub scan direction. Thus, the boundary between the high printing ratio region and the low printing ratio region is continuously changed (or draws an undulating line) in the direction in which nozzles are arranged. Thus, the frequencies at which nozzles are used can be equalized, thus increasing the service life of the entire print head and reducing the stripe-like uneven density among the respective regions.

Figure 29:
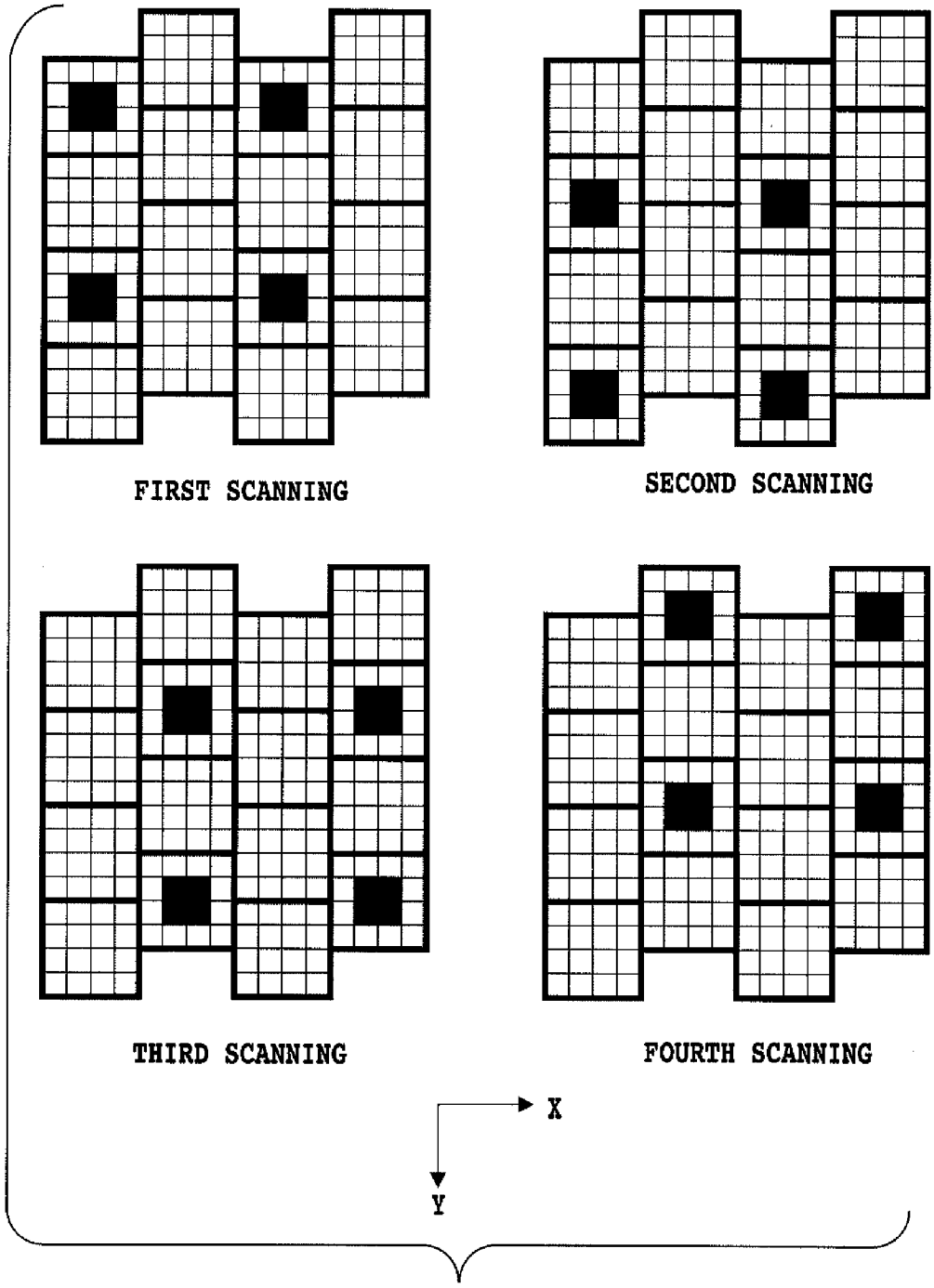
FIG. 29 illustrates another example in which the image data shown in FIG. 27 is divided so as to correspond to the respective scans of the divided printing.
Figure 30:
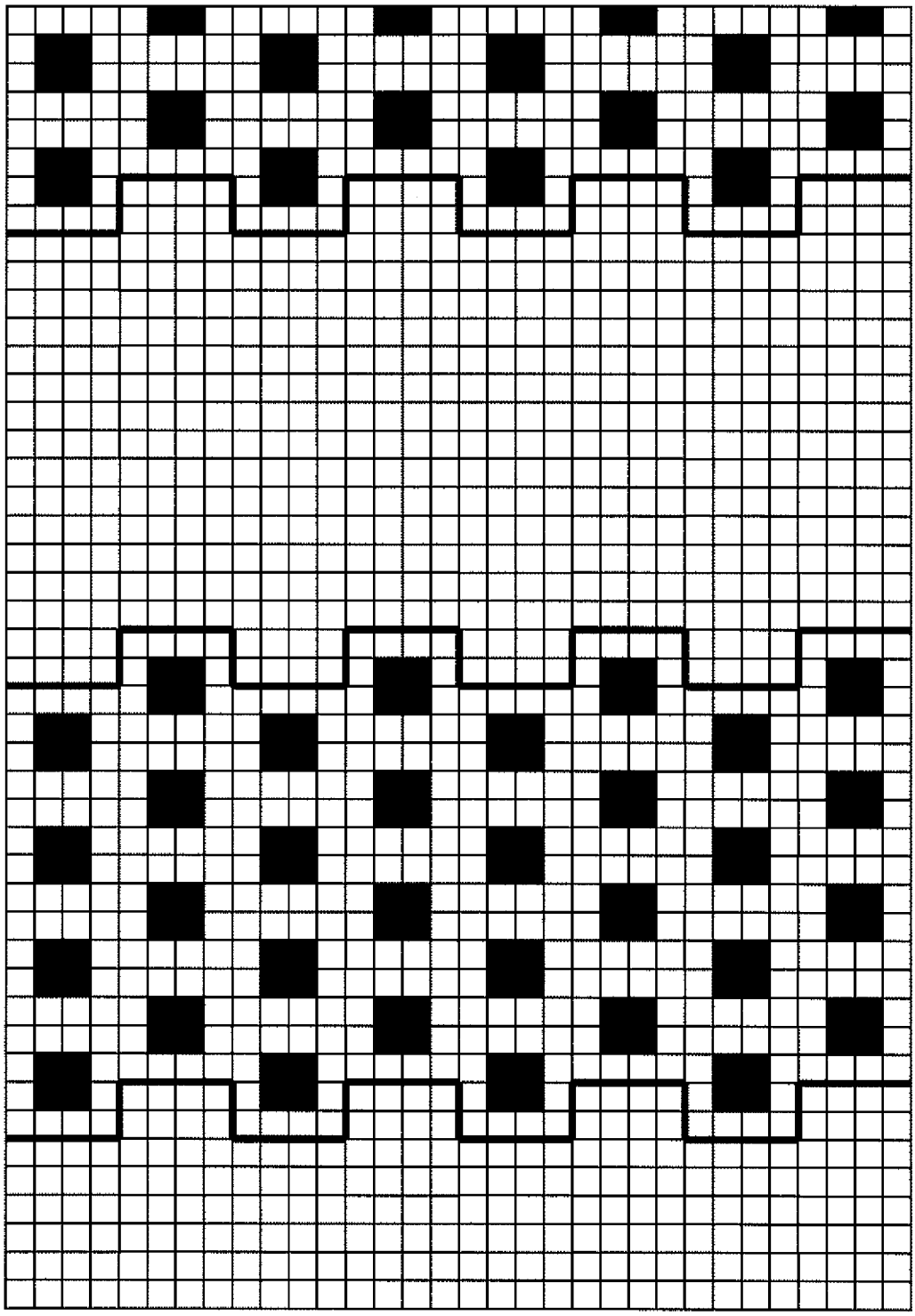
FIG. 30 illustrates another example of the image data printed by the dot concentrated area coverage modulation method in the embodiment of the present invention.

On the other hand, FIG. 29 shows another example in which the image data subjected to the dot concentrated region coverage modulation shown in FIG. 26 is divided to four printing scans. This example also shows that the cells have the resolution of 120 dpi and an image is formed by 4×4 shape units and the high printing ratio region is 0.08 mm which corresponds to four nozzle arrays. This can reduce the level of eddy flow and can print an image having a favorable quality.

The present invention also can be applied to an ink jet printing apparatus printing apparatus using a print head for ejecting a plurality types of inks having substantially the same hue and having different densities or an ink jet printing apparatus printing apparatus using a print head in which nozzles for ejecting different amounts of ink are arranged. In any case, the widths of the high printing ratio region and the low printing ratio region may be determined in accordance with the number of nozzle arrays to be used, the type of ink, the type of a print medium, the printing ratio, and the amount of ink droplets to be printed for example.

Figure 16:
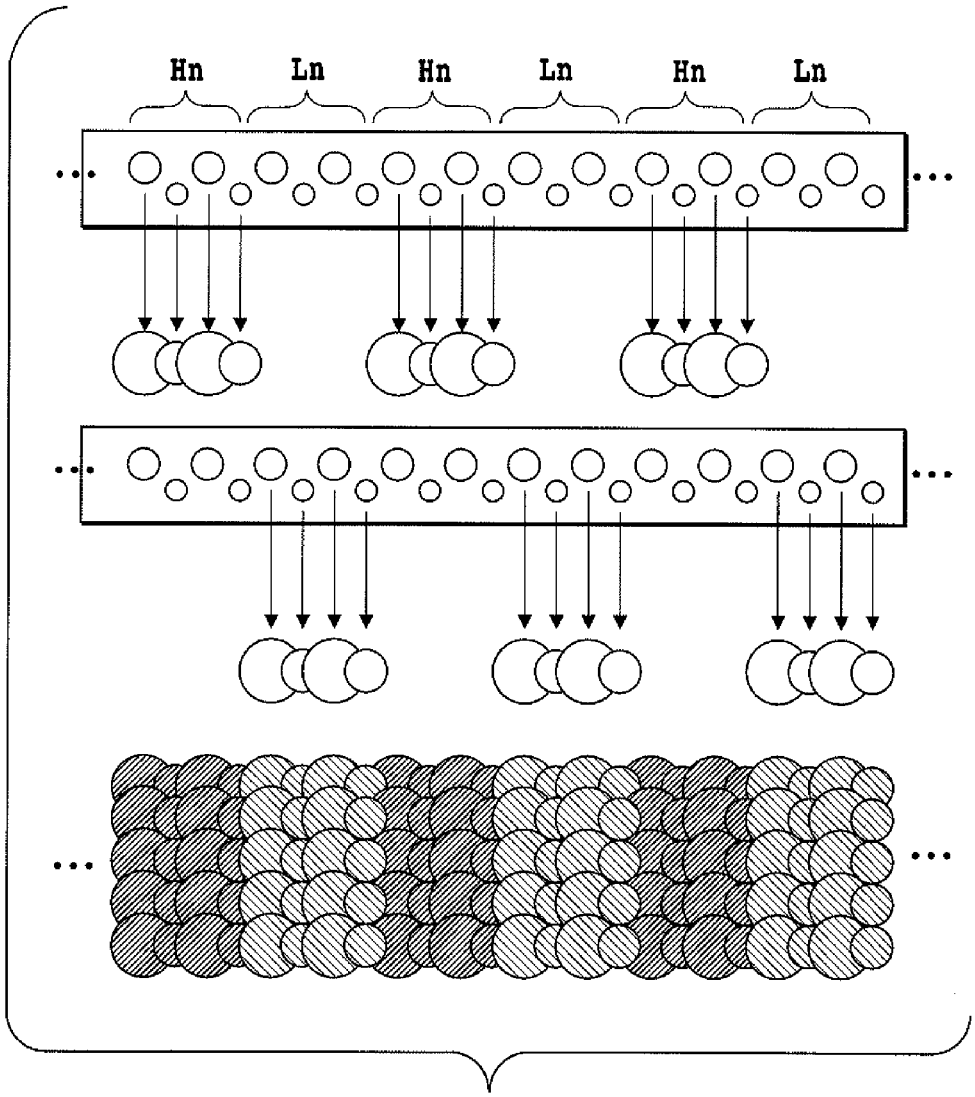
FIG. 16 shows another example of the ink ejection operation in the embodiment of the present invention and how ink droplets land.

FIG. 16 schematically shows a case in which a printing operation is performed using a print head in which nozzles for ejecting 6 pl (large nozzles) and nozzles for ejecting 1 pl (small nozzles) are arranged alternately with the arrangement density of 1200 dpi. In FIG. 16, the total of four nozzles of two large nozzles and two small nozzles are set as the high printing ratio region Hn. The low printing ratio region Ln is also composed of the total of four nozzles of two large nozzles and two small nozzles. This configuration completes an image by the total of two scans.

This case also provides the high printing ratio region Hn of 0.08 mm, thus providing a printing with a low eddy flow level to print a favorable image.

By the way, an ink jet printing method by which the nozzle array having a high density as described above can be realized in a relatively easy manner and with a low cost includes, for example, an ink jet printing method by which heat energy in a print head is used to form flying ink droplets for printing. However, the present invention is not particularly limited to this.

EMBODIMENT

Next, the present invention will be described in more detail by the examples as shown below.

Example 1

In the full-line-type ink jet printing apparatus printing apparatus shown in FIG. 1, the ink jet print head shown in FIG. 2 was used to perform a printing operation. In this operation, ink ejected from the print head was commercially-available black ink (BCI6) for BJF900 (made by Canon Inc.). Each ink droplet was set to be ejected in an amount of 2.5±0.5 pl.

With regards to a print medium, an ink jet-exclusive photo gloss paper (pro-photo paper, PR101 made by Canon Inc.) was prepared.

FIG. 17 schematically shows the nozzle arrays of the print head and the mask pattern M used in this example. Although the print head shown in FIG. 17 actually has the structure shown in FIG. 2, the print head in FIG. 17 is shown so that the nozzles arranged in a staggered manner shown in FIG. 2 are considered as one row for convenience.

Figure 17A:
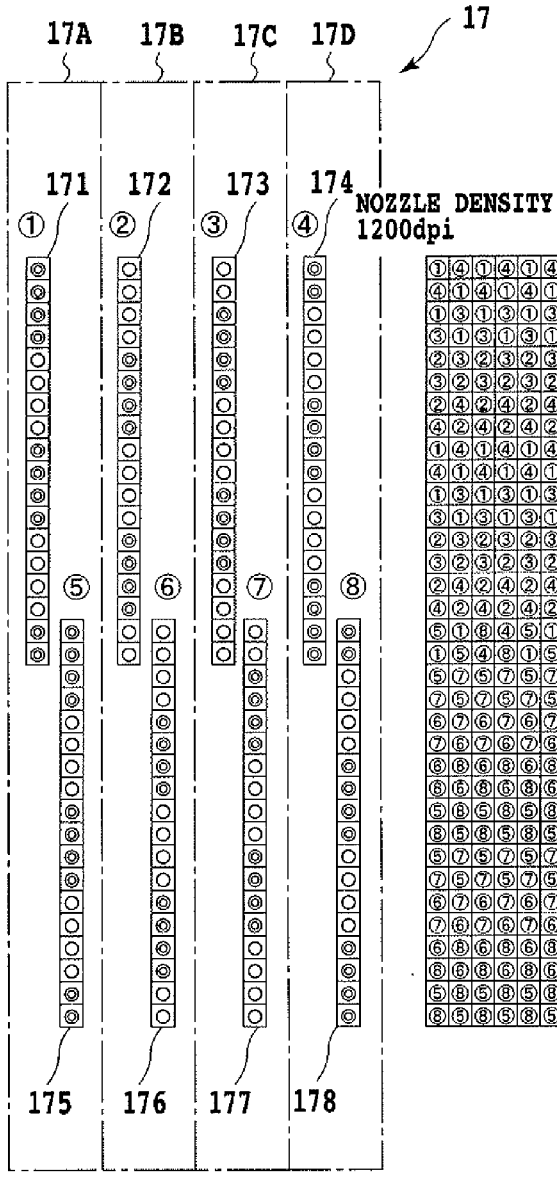
FIG. 17A and FIG. 17B are schematic views illustrating an example of a nozzle array and a mask pattern used in Example 1 of the present invention.
Figure 17B:
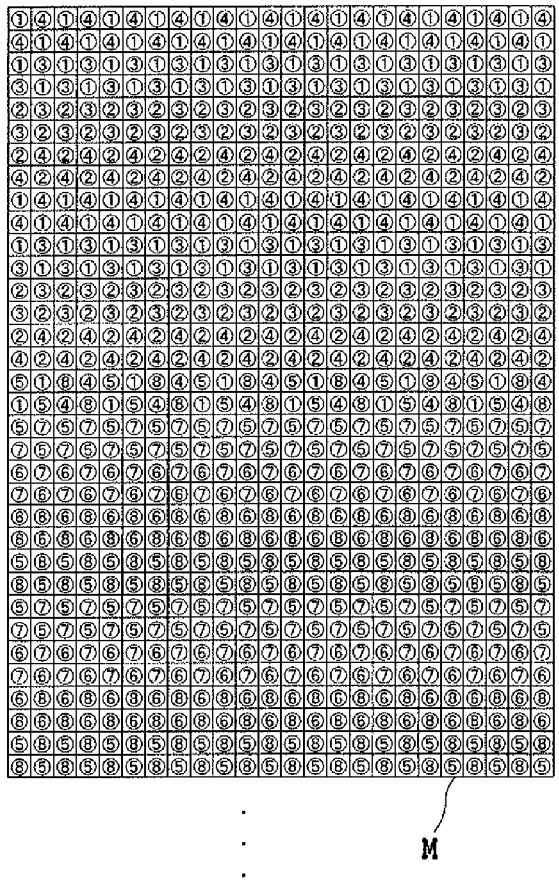

The upstream side first nozzle array 17A consisting of the nozzle arrays 171 and 175 of FIG. 2 (intermediate nozzle array) prints to-be-printed data represented by the circled number 1 and the circled number 5 in FIG. 17B. FIG. 17B shows the mask pattern M for performing a thinning-out processing.

Next, the second nozzle array 17B consisting of the reference numerals 172 and 176 of FIG. 2 prints to-be-printed data represented by the circled number 2 and the circled number 6 in FIG. 17. Similarly, the third nozzle array 171C prints to-be-printed data represented by the circled number 3 and the circled number 7. The fourth nozzle array 171D prints to-be-printed data represented by the circled number 4 and the circled number 8.

In FIG. 17A, a region consisting of nozzles shown by double circles in the nozzle array 171 represents a high printing ratio region. This high printing ratio region is a reed-shaped region having a region width for four nozzles with a density of 1200 dpi (i.e., width of 0.08 mm). A region consisting of nozzles shown by circles in the nozzle array 171 represents a low printing ratio region. In FIG. 17A, the low printing ratio region does not provide ink eject.

In the nozzle arrays 171A and 171D, the two intermediate nozzle arrays 171 and 175 as well as the two intermediate nozzle arrays 174 and 178 for constituting them respectively are connected so that the end parts are overlapped to each other. A nozzle corresponding to the connected part is positioned at the high printing ratio region for both of the nozzle arrays. This can reduce the deterioration of an image at the connected part.

The printing conditions for the printing operation were determined such that the eject frequency was 30 kHz and the relative movement speed of the print head and the print medium was 25 inch/s. As a result, the deterioration of an image presumably caused by the influence by eddy flow was reduced, providing an image with a high quality.

Comparison Example 1

Figure 18A:
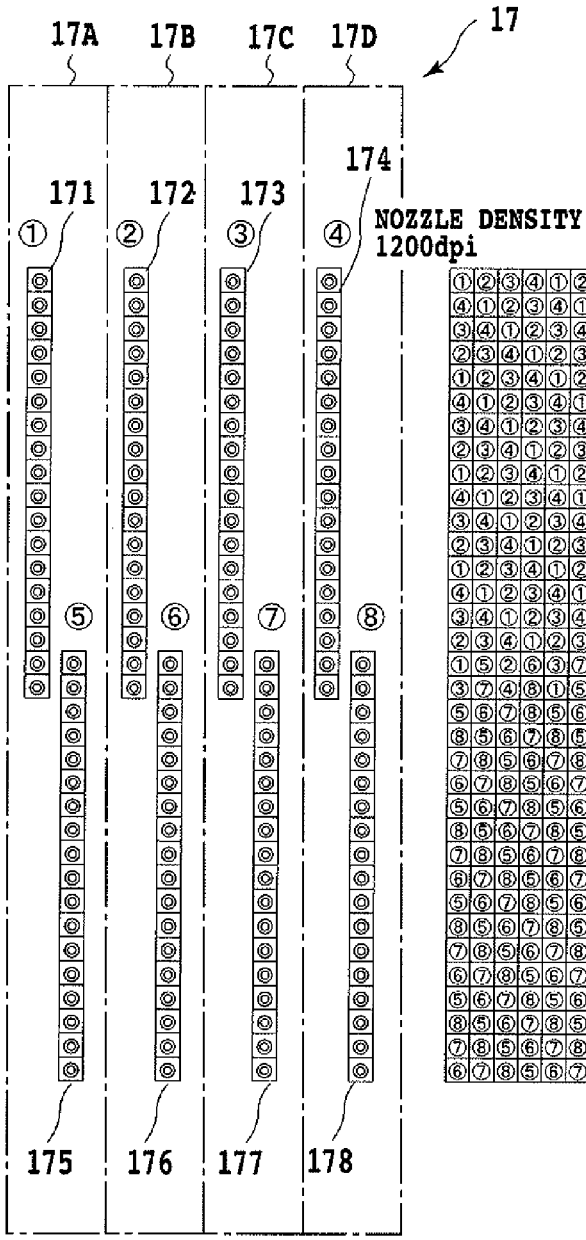
FIG. 18A and FIG. 18B are schematic views illustrating another example of a nozzle array and a mask pattern used in a comparison example to the example of the present invention.
Figure 18B:
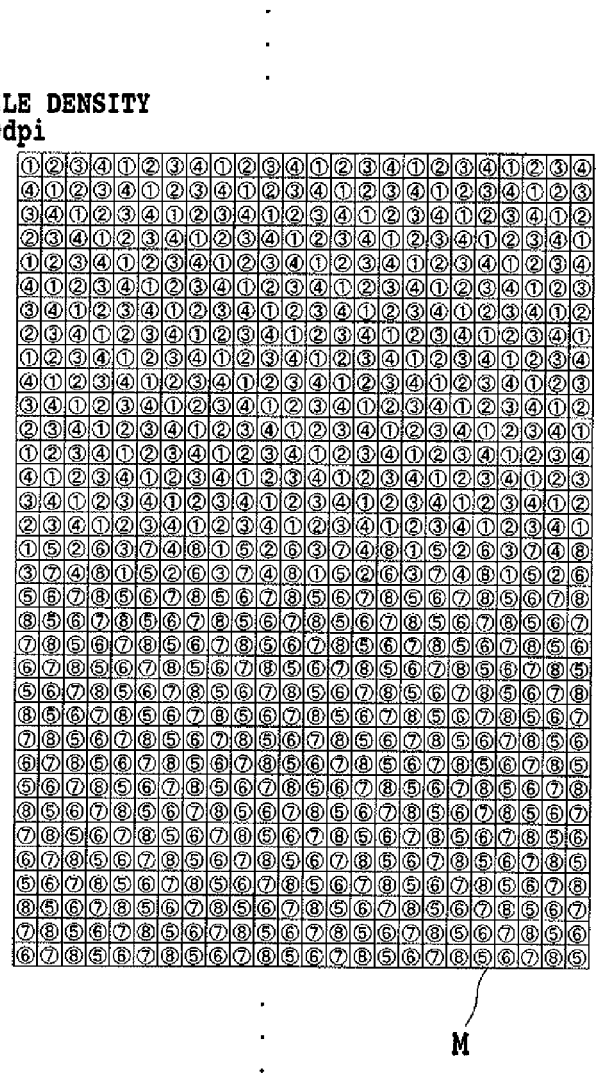

The same ink jet printing apparatus printing apparatus as that of Example 1 was used to perform a divided printing by the mask pattern M for uniformly thinning-out the image data to the nozzle array as shown in FIG. 18A (see FIG. 18B). In this case, uneven density presumably caused by an influence by eddy flow was caused and thus only an image having a low quality could be obtained.

Example 2

The same ink jet printing apparatus printing apparatus as that of Example 1 was used to perform a divided printing by the high printing ratio region and the low printing ratio region as shown in FIG. 17. In this case, the width of the high printing ratio region was increased so that a nozzle array having a density of 1200 dpi corresponds to 16 nozzles (0.32 m). The printing as described above did not cause uneven density presumably caused by an influence by eddy flow, providing an image having a high quality.

Example 3

The same ink jet printing apparatus printing apparatus as that of Example 1 was used to perform a divided printing by the high printing ratio region and the low printing ratio region.

In this case, the width of the high printing ratio region was further increased so that a nozzle array having a density of 1200 dpi corresponds to 64 nozzles (1.2 m). The printing as described above also reduced uneven density presumably caused by an influence by air current, providing an image having a high quality. However, a very small amount of stripe-like uneven density with a predetermined width of pitch was visually recognized.

Comparison Example 2

The same ink jet printing apparatus printing apparatus as that of Example 1 was used to perform a divided printing by the high printing ratio region and the low printing ratio region as shown in FIG. 17. In this case, the width of the high printing ratio region was further increased so that a nozzle array having a density of 1200 dpi corresponds to 128 nozzles (2.4 m). The printing as described above showed remarkable stripe-like uneven density with a predetermined pitch and showed a difficulty in providing an image with a high quality. This was assumed to be caused by uneven density within a predetermined width that was presumably caused by an influence by air current.

Example 4

Figures 19A, 19B:
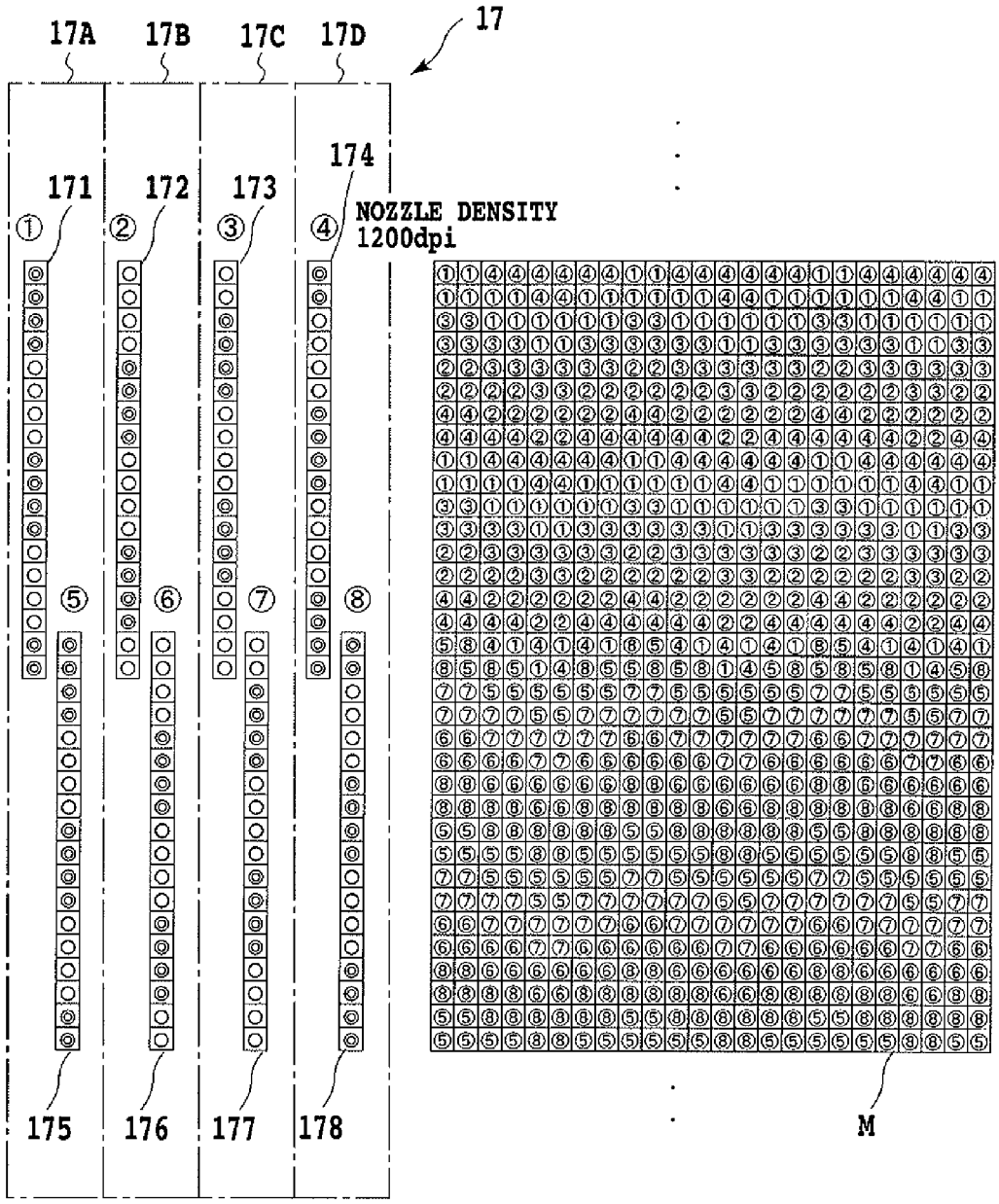
FIG. 19A and FIG. 19B are schematic views illustrating another example of a nozzle array and a mask pattern used in Example 4 of the present invention.

The same ink jet printing apparatus printing apparatus as that of Example 1 was used. The mask pattern M in which reed-shaped high printing ratio regions extending in the main scan direction as shown in FIG. 19B are arranged to draw an undulating line in the direction in which a print medium is transported was used to thin-out image data to perform a divided printing by the line head 17 shown in FIG. 19A. The printing as described above did not cause uneven density presumably caused by an influence by eddy flow, providing an image having a high quality.

Example 5

The print head 22 having nozzle arrays in which 768 nozzles for ejecting an average amount of 2.5 pl as shown in FIG. 4 are arranged with 1200 dpi was prepared. This head was attached to the serial-type ink jet printing apparatus printing apparatus shown in FIG. 3 to perform a printing. Each ink droplet was ejected in an amount of 2.5±0.5 pl. In this case, commercially-available black ink (BCI6) for BJF900 (made by Canon Inc.) was used.

With regards to a print medium, an ink jet-exclusive photo gloss paper (pro-photo paper, PR101 made by Canon Inc.) was prepared.

Figure 20:
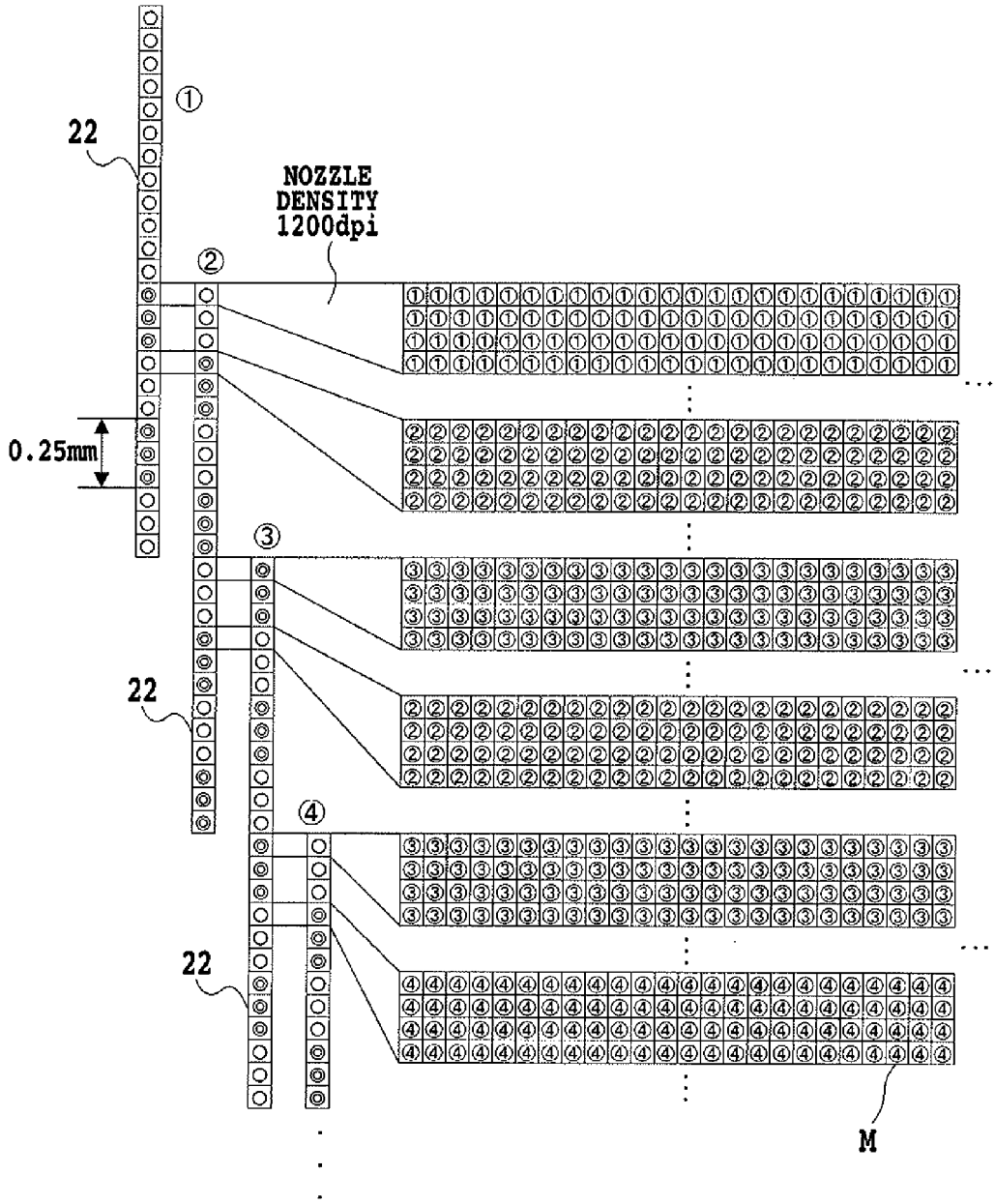
FIG. 20 is a schematic view illustrating another example of a nozzle array and a mask pattern used in Example 5 of the present invention.

FIG. 20 shows a divided printing in which an image is completed by two scans to a single printing region. Although the print head shown in FIG. 20 actually has the structure shown in FIG. 4, the print head in FIG. 20 is shown so that the nozzles arranged in a staggered manner shown in FIG. 4 are considered as one row for convenience.

In this printing operation, data at the position shown by the circled number 1 of FIG. 20 is printed by the first scan. Then, data at the position shown by the circled number 2 of FIG. 20 is printed by the second scan. Then, data at the position shown by the circled number 3 of FIG. 20 is printed by the third scan. By repeating the above operations, the image was completed. In FIG. 20, a region consisting of nozzles shown by double circles represents a high printing ratio region which is set to have a width for 12 nozzles (0.25 mm) with 1200 dpi. The same applies to a printing ratio region. The printing conditions were determined such that the eject frequency was 30 kHz and the relative movement speed of the print head and the print medium was 25 inch/s.

The printing operation under the printing conditions as described above did not cause uneven density presumably caused by an influence by eddy flow, providing an image having a high quality.

Comparison Example 3

Figure 21:
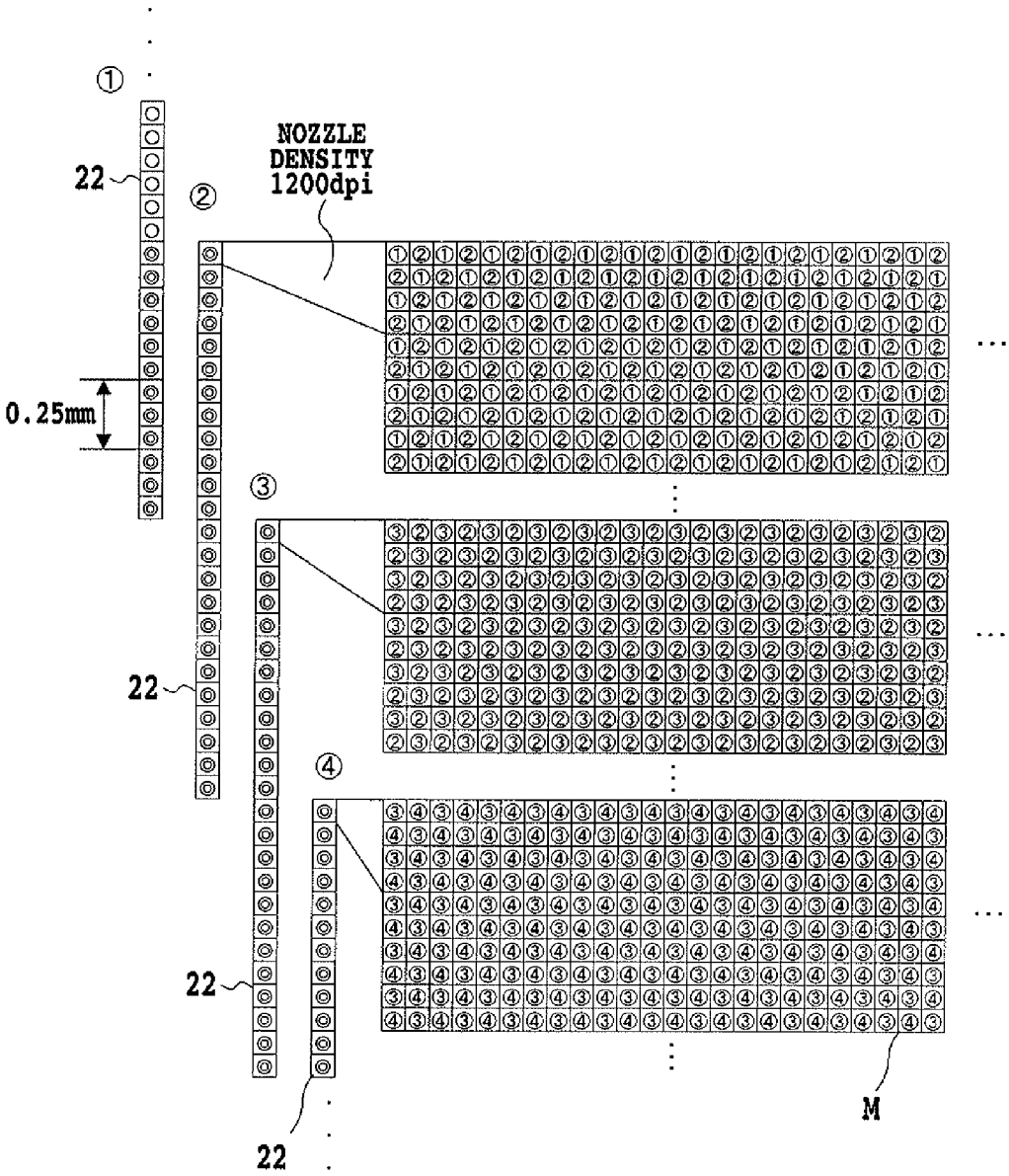
FIG. 21 is a schematic view illustrating another example of a nozzle array and a mask pattern used in a comparison example to the example of the present invention.
Figure 22:
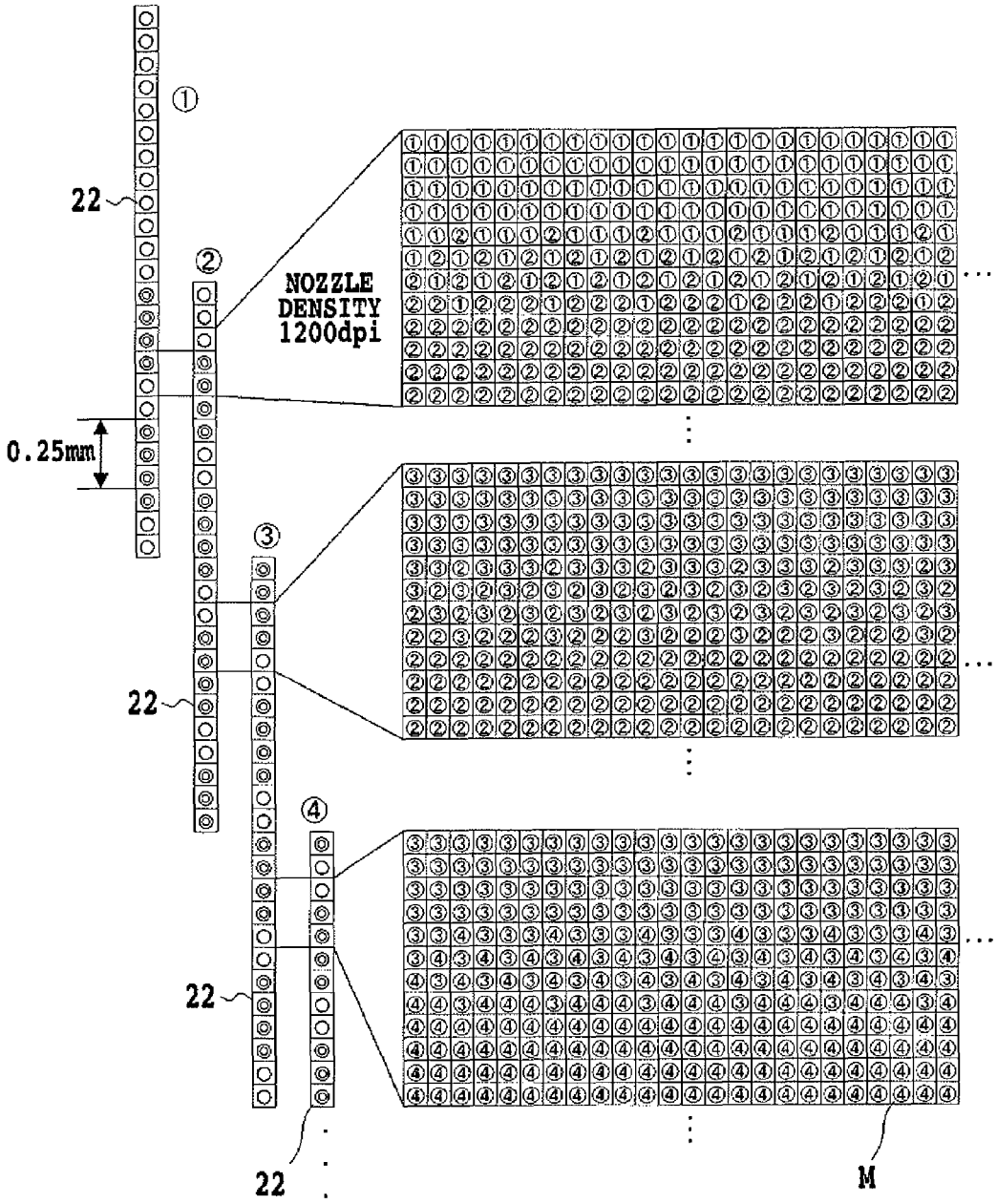
FIG. 22 is a schematic view illustrating another example of a nozzle array and a mask pattern used in Example 6 of the present invention.

The same ink jet printing apparatus printing apparatus as that of Example 5 was used. The thinning-out mask pattern shown in FIG. 21 was used to uniformly allocate to-be-printed data to the nozzle arrays of the print head 22 to perform a divided printing. In this case, uneven density presumably caused by an influence by eddy flow was caused and thus only an image having a low quality could be obtained.

Example 6

The same ink jet printing apparatus printing apparatus as that of Example 4 was used. The thinning-out mask pattern in which the boundary between the high printing ratio region and the low printing ratio region has an inclined printing ratio was used to thin-out to-be-printed data and the print head 22 was used to perform a divided printing. The printing as described above did not cause uneven density presumably caused by an influence by eddy flow, providing an image having a high quality.

Example 7

Figure 23:
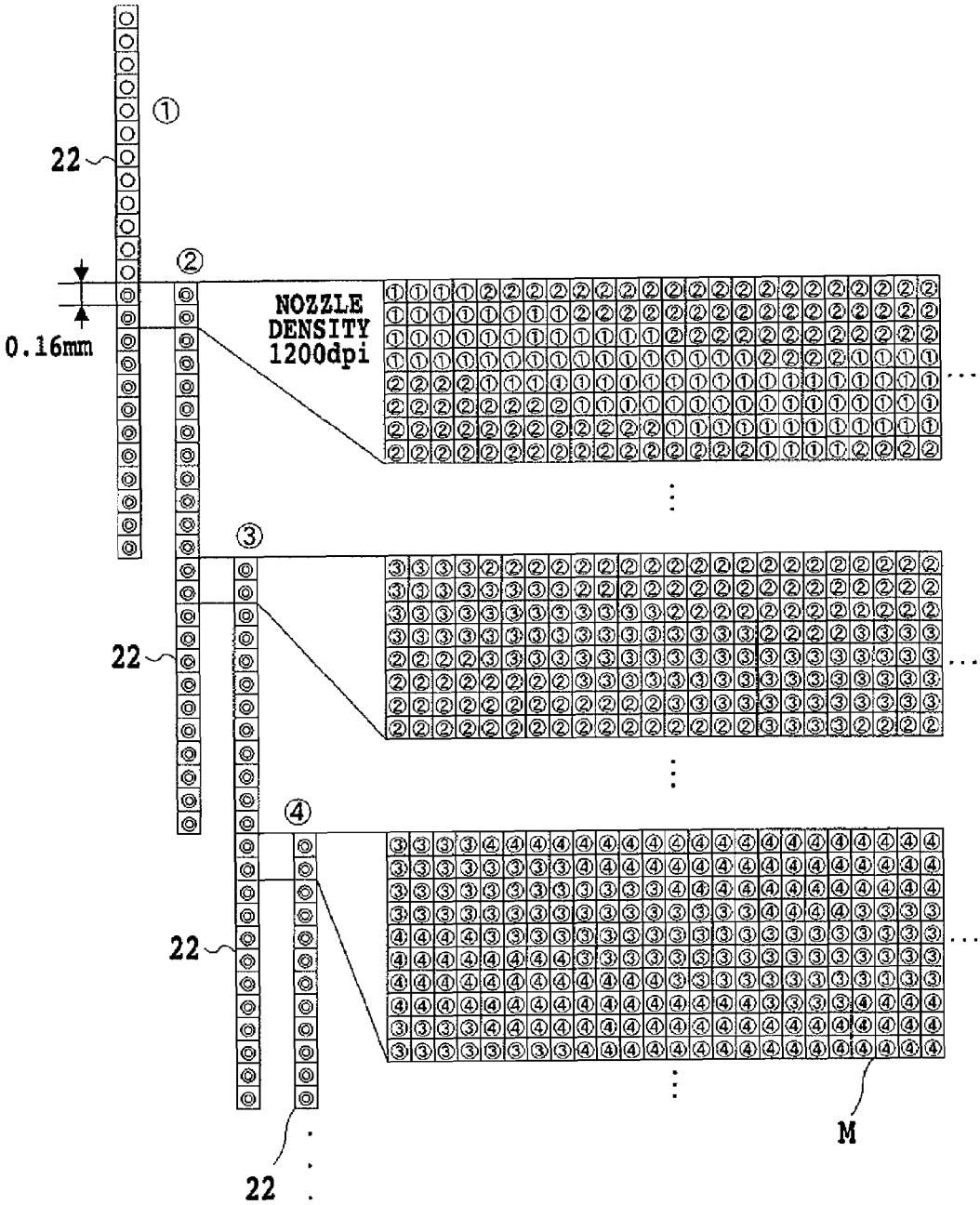
FIG. 23 is a schematic view illustrating another example of a nozzle array and a mask pattern used in Example 7 of the present invention.

The same ink jet printing apparatus printing apparatus as that of Example 4 was used. The thinning-out mask pattern M as shown in FIG. 23 in which the high printing ratio regions are arranged to draw an undulating line in s stepwise manner was used to thin-out to-be-printed data and the print head 22 was used to perform a divided printing. The printing as described above did not cause uneven density presumably caused by an influence by eddy flow, providing an image having a high quality.

Example 8

Figure 24:
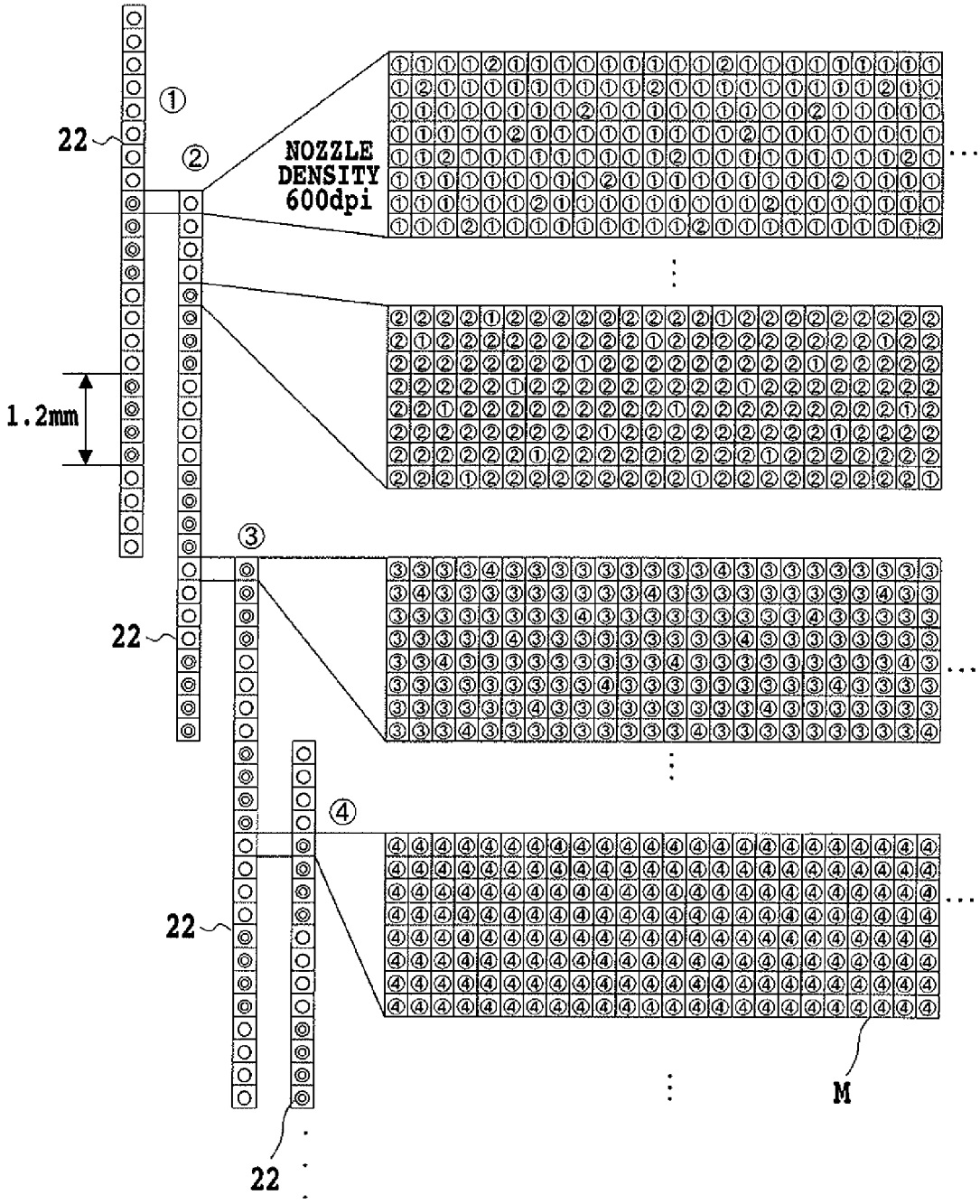
FIG. 24 is a schematic view illustrating another example of a nozzle array and a mask pattern used in Example 8 of the present invention.

The same ink jet printing apparatus printing apparatus as that of Example 4 was used. The arrangement as shown in FIG. 24 was used in which the nozzle array in which nozzles are arranged with a density of 600 dpi includes the high printing ratio regions having the printing ratio of 90% and the low printing ratio regions having the printing ratio of 10%. Then, a divided printing was performed by the high printing ratio regions having a width of 1.2 mm. The printing as described above reduced uneven density presumably caused by an influence by eddy flow, providing an image having a high quality.

Example 9

Figure 25:
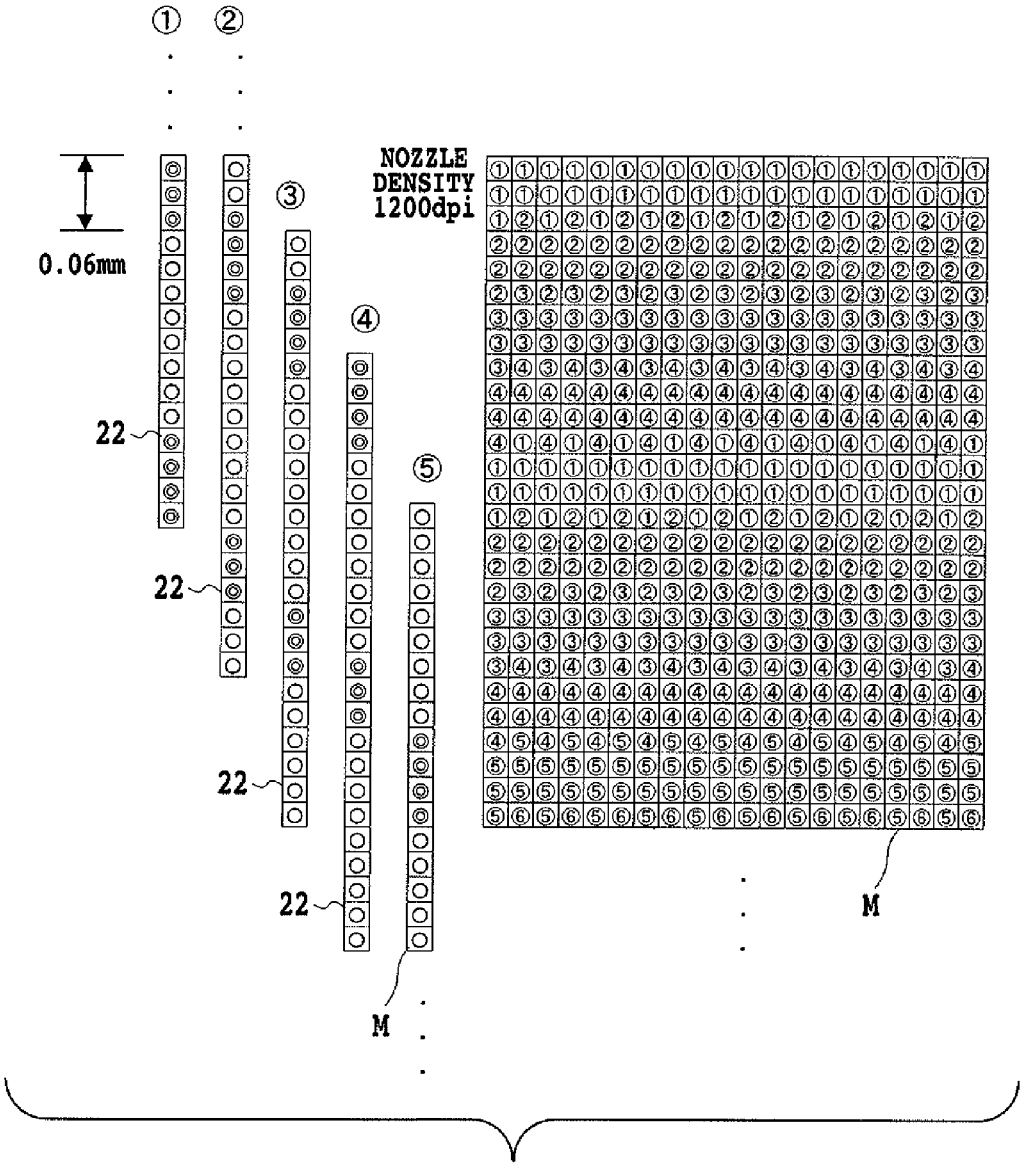
FIG. 25 is a schematic view illustrating another example of a nozzle array and a mask pattern used in Example 9 of the present invention.

The same ink jet printing apparatus printing apparatus as that of Example 4 was used. The thinning-out mask pattern M as shown in FIG. 25 in which the width of the high printing ratio region was set to be 0.8 mm and the printing is divided to four scans was used to thin-out to-be-printed data and the print head 22 was used to perform a divided printing. The printing as described above did not cause uneven density presumably caused by an influence by eddy flow, providing an image having a high quality.

Example 10

The same ink jet printing apparatus printing apparatus as that of Example 4 was used to develop the binarized image data subjected to the area coverage modulation shown in FIG. 31 as shown in FIG. 27. Then, a multipass printing by four passes was performed in accordance with the image data by the first to fourth scans shown in FIG. 26. In this case, a printing matrix consisted of 4×4 cells and each cell was set to have a density of 1200×1200 dpi. Thus, an image was printed by repeating the unit of 0.8 mm in the nozzle array direction. The high printing ratio region was reed-shaped to have a width of 0.8 mm. The printed image did not show uneven density presumably caused by an influence by eddy flow, providing an image having a high quality.

Example 11

The same ink jet printing apparatus printing apparatus as that of Example 4 was used to develop the binarized image data subjected to the area coverage modulation shown in FIG. 31 as shown in FIG. 27. Then, a multipass printing by four passes was performed in accordance with the image data by the first to fourth scans shown in FIG. 29. In this case, a printing matrix also consisted of 4×4 cells and each cell was set to have a density of 1200×1200 dpi. Thus, an image was printed by repeating the unit of 0.8 mm in the nozzle array direction. The high printing ratio region was reed-shaped to have a width of 0.8 mm. Thus, the printed image did not show uneven density presumably caused by an influence by eddy flow, providing an image having a high quality.

Example 12

The same ink jet printing apparatus printing apparatus as that of Example 8 was used to perform a printing in accordance with image data based on a shape unit of a printing matrix consisting of 4×4 cells. In this case, the thinning-out mask pattern M was set to include low printing ratio regions among high printing ratio regions so that the low printing ratio regions are an integral multiple of shape units. Then, a multipass printing by two passes was performed. The printing was performed so that the respective passes correspond to the positions of the high printing ratio regions and low printing ratio regions of FIG. 28. The printing matrix was composed by 4×4 cells and each cell was set to have a density of 1200×1200 dpi. Thus, an image was printed by repeating the unit of 0.8 mm in the nozzle array direction. The high printing ratio region was reed-shape to have a width of 0.32 mm. The printing as described above reduced uneven density presumably caused by an influence by eddy flow, providing an image having a high quality.

As described above, the present invention is effective when a serial-type printing apparatus printing apparatus using a print head in which relatively short nozzle arrays are arranged is used to perform a divided printing (e.g., multipass printing) or when a full-line-type printing apparatus printing apparatus in which a plurality of relatively long nozzle arrays are arranged is used to perform a printing. Specifically, any of the printing methods can remarkably improve the fluctuation of ink landing positions of ink droplets due to eddy flow caused between the print head and the print medium, thereby providing a high-quality printed material with a high speed. The present invention also can be appropriately used for the printing by a dot-concentrated type area coverage modulation method to provide a high-speed printing while maintaining the gradation reproducibility.

The present invention is applicable to all devices using printing media such as paper, cloth, leather, nonwoven fabric, OHP sheet, and metal. Specifically, the present invention is applicable to office machines (e.g., printer, copier, facsimile) and industrial production machines for example.

The present invention is also suitable for a case where an area coverage modulation method that is widely known as "screen half toning method" called as the cluster type or the dot concentrated type is realized by an ink jet type printed. Printers for realizing the area coverage modulation method include a proof type printer widely used in the printing business.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet printing apparatus for causing a plurality of nozzles arranged in a print head to eject ink droplets while the print head scans relative to a print medium, to print an image on the print medium, the apparatus comprising:

scanning means for causing the print head to scan a same printing region of the print medium a plurality of times;

thinning-out means for dividing image data corresponding to the same print region to pieces of image data to be printed by the respective plurality of scans by thinning-out image data corresponding to the same print region; and printing control means for printing, in accordance with the image data thinned out by the thinning-out means in the respective plurality of scans, a thinned-out image on the same print region to complete an image to be printed on the same print region, wherein the thinning-out means thins out image data to be printed on a plurality of same print regions at which the print head passes in one scanning with high and low thinning-out ratios in turn in a direction in which the nozzles are arranged.

2. The ink jet printing apparatus according to claim 1, wherein the position of the boundary is displaced in a wave-like manner along the scanning direction.

3. An ink jet printing apparatus for causing a plurality of nozzles arranged in a print head to eject ink droplets while the print head scans relative to a print medium, to print an image on the print medium, the apparatus comprising:

scanning means for scanning the print head to a same print region of the print medium a plurality of times;

conversion means for converting multivalued image data that corresponds to the respective pixels constituting an image to be printed on the same print region to binary image data;

thinning-out means for thinning-out the binary image data corresponding to the same print region by using different mask patterns corresponding to respective plurality of scans to the same print region; and printing control means for printing, based on the binary image data thinned out by the thinning-out means in the respective plurality of scans, a thinned-out image on the same print region to complete the image to be printed on the same print region;

wherein the respective different mask patterns are defined so that a first region for thinning-out the binary image data with a relatively high thinning-out ratio and a second region for thinning-out the binary image data with a relatively low thinning-out ratio are repeatedly arranged in a direction, in which the nozzles are arranged, in the unit of an integral multiple of the width of the pixel.

4. The ink jet printing apparatus according to claim 3, wherein the conversion means allocates a dot concentration-type dot arrangement pattern to the pixel to convert the multivalued image data to the binary image data.

5. The ink jet printing apparatus according to claim 3, wherein the position of a boundary between the first region and the second region in the direction in which the nozzles are arranged is different in accordance with a position in the scanning direction.

6. The ink jet printing apparatus according to claim 5, wherein the position of the boundary is displaced in a stepwise manner along the scanning direction.

7. The ink jet printing apparatus according to claim 3, wherein the mask pattern has a plurality types of the first regions having different widths in a direction in which the nozzles are arranged and a plurality types of the second regions having different widths in a direction in which the nozzles are arranged.

8. An ink jet printing method for causing a plurality of nozzles arranged in a print head to eject ink droplets while the print head scans relative to a print medium, to print an image on the print medium, the method comprising:

a scanning step for scanning the print head to scan a same printing region of the print medium a plurality of times;

a thinning-out step for dividing image data corresponding to the same print region to image data to be printed in the respective plurality of scans by thinning-out image data corresponding to the same print region; and a printing step for printing thinned-out image on the same print region in accordance with image data thinned out by the thinning-out step in the respective plurality of main scans to complete an image to be printed on the same print region, wherein, in the thinning-out step, image data to be printed on a plurality of the same print regions at which a nozzle array of the print head passes during one scan is thinned out at high and low thinning-out ratios alternately in a direction in which the nozzles are arranged.

9. An ink jet printing method for causing a plurality of nozzles arranged in a print head to eject ink droplets while the print head scans relative to a print medium to form an image on the print medium, the method comprising:

a step for causing the print head to scan to a same print region of the print medium a plurality of times;

a step for converting multivalued image data that corresponds to the respective pixels constituting an image to be printed on the same print region to binary image data;

a step for thinning-out binary image data corresponding to the same print region using different mask patterns respectively corresponding to a plurality of scans to the same print region; and a step for printing, in the respective plurality of scans, thinned-out images on the same print region based on the thinned-out binary image data to complete an image to be printed on the same print region, wherein the respective different mask patterns include an arrangement of an region in which a printing of the binary image data is permitted and an region in which a printing of the binary image data is not permitted and are defined so that a part relatively highly occupied by the printing-permitted region and a part relatively lowly occupied by the printing-permitted region are repeatedly arranged along a direction, in which the nozzles are arranged, in the unit of an integral multiple of the width of the pixel.

* * * * *